US007272965B2

(12) United States Patent
Dolev

(10) Patent No.: US 7,272,965 B2
(45) Date of Patent: Sep. 25, 2007

(54) METHOD AND ASSEMBLY TO PREVENT IMPACT-DRIVEN MANIPULATION OF CYLINDER LOCKS

(76) Inventor: Moshe Dolev, 17 Bereishit St., Ramat HaSharon (IL) 47201

( * ) Notice: Subject to any disclaimer, the term of this patent is extended or adjusted under 35 U.S.C. 154(b) by 0 days.

(21) Appl. No.: 10/630,916

(22) Filed: Jul. 31, 2003

(65) Prior Publication Data

US 2005/0022568 A1 Feb. 3, 2005

(51) Int. Cl.
*E05B 27/04* (2006.01)

(52) U.S. Cl. ..... 70/276; 70/358; 70/378; 70/419; 70/493; 70/DIG. 29

(58) Field of Classification Search ..... 70/359, 70/419, 421, 378, 392, 491, 493–496, DIG. 22, 70/DIG. 29, DIG. 75, 276, 358, DIG. 2, 70/DIG. 5, DIG. 15, DIG. 76
See application file for complete search history.

(56) References Cited

U.S. PATENT DOCUMENTS

| | | | | | |
|---|---|---|---|---|---|
| 1,172,203 | A * | 2/1916 | Fuller | 70/276 |
| 2,158,501 | A * | 5/1939 | Gutman | 70/493 |
| 2,192,371 | A * | 3/1940 | Brantingson | 70/493 |
| 2,194,959 | A * | 3/1940 | Voight | 70/419 |
| 2,565,531 | A * | 8/1951 | Spiegler | 70/493 |
| 3,494,158 | A * | 2/1970 | Bauer et al. | 70/493 |
| 3,599,456 | A * | 8/1971 | Bessim | 70/493 |
| 3,802,234 | A * | 4/1974 | Gerlach | 70/421 |
| 3,818,732 | A * | 6/1974 | Tria et al. | 70/359 |
| 4,098,103 | A * | 7/1978 | Raskevicius | 70/494 |
| 4,103,526 | A * | 8/1978 | Surko, Jr. | 70/494 |
| 4,227,387 | A * | 10/1980 | Steinbach | 70/491 |
| 4,403,486 | A * | 9/1983 | Miyake | 70/383 |
| 5,123,268 | A * | 6/1992 | Eizen | 70/359 |
| 5,966,971 | A * | 10/1999 | Keller | 70/359 |
| 6,675,617 | B2 * | 1/2004 | Stemmerik | 70/493 |
| 2005/0204788 | A1 * | 9/2005 | Almoznino | 70/359 |

FOREIGN PATENT DOCUMENTS

| | | |
|---|---|---|
| DE | 633753 | * 8/1936 |
| EP | 0452297 | * 10/1991 |

* cited by examiner

*Primary Examiner*—Lloyd A. Gall
(74) *Attorney, Agent, or Firm*—Edward Langer; Shiboleth, Yisraeli, Roberts, Zisman & Co.

(57) ABSTRACT

A method and assembly for preventing unauthorized manipulation of common cylinder locks, as executed by use of the principles of the Bumpkey or Blowgun methods. The pin assembly, containing a tumbler pin and a driver pin, is adapted so as to alter linear displacement thereof, by forming a recession in one of the pins contained in the pin assembly, and an engagement element, in the other of the pins, for engaging the recession, such that when an impact-driven blow of a given intensity is applied so as to linearly displace the tumbler and driver pins, the pin engagement element engages the pin recession, strongly binding the tumbler and driver pins together, thereby, blocking the shear line and, consequently, preventing unauthorized manipulation of the common cylinder lock.

8 Claims, 20 Drawing Sheets

METHOD AND ASSEMBLY TO PREVENT IMPACT-DRIVEN MANIPULATION OF CYLINDER LOCKS

FIELD OF THE INVENTION

The present invention relates to common cylinder locks, which employ pins that are linearly displaceable, and more particularly, to a method and assembly for preventing unauthorized manipulation of common cylinder locks, as employed by burglars using methods based on the physical phenomenon of impact and momentum, such as the Bumpkey or Blowgun methods.

BACKGROUND OF THE INVENTION

The prior art of cylinder locks and their operation is based on using a key whose various features serve to displace a number of pins, arranged as pin assemblies, to predefined positions, thereby allowing the rotation of the cylinder.

Cylinder locks are vulnerable to many methods of unauthorized manipulation, prominent among them the Bumpkey and Blowgun methods. These methods employ the well-known physical phenomenon of impact and momentum.

A tool for lock manipulation known as a Blowgun, is comprised of a narrow, strong metallic portion that is inserted into the lock keyway instead of a key, and a gun-like portion which imparts and transmits an impact-driven blow along the length of the metallic portion via the tumbler pins to the driver pins. In conjunction with the Blowgun, a tension rod is used to apply rotational force to the cylinder plug. When the impact-driven blow is transmitted to the driver pins and they are knocked out of position, clearing the shear line, the plug rotates slightly, due to the rotational force exerted by the tension bar, and thereby prevents the pins from returning to their locking position. The cylinder plug may now be freely rotated and the lock opened.

Using a Blowgun requires a great deal of expertise in order to discover the exact impact-driven blow intensity required. However, a simpler burglary tool, called the Bumpkey has been developed. Instead of using the narrow, metallic portion of the Blowgun, a key blank is used. The key blank depressions are all as deep as possible. In this method, a small hammer is used to impact the Bumpkey. Less expertise is required in order to discover the exact impact-driven blow intensity required. This new development compromises lock security and poses a grave danger to the public and a challenge to the cylinder lock industry, Therefore, it would be desirable to provide a method and assembly for preventing unauthorized manipulation of common cylinder locks, as employed by burglars using methods based on the physical phenomenon of impact and momentum, such as the Bumpkey or Blowgun methods.

SUMMARY OF THE INVENTION

Accordingly, it is a principal object of the present invention to overcome the above mentioned cylinder lock manipulation problems and provide a method and assembly for preventing unauthorized manipulation of common cylinder locks, using the Bumpkey or Blowgun methods, or any other method that is based on the principles of the impact and momentum phenomenon.

In accordance with a preferred embodiment of the present invention, there is provided, in a common cylinder lock, having a plurality of standard pin assemblies, each of said plurality of standard pin assemblies disposed in a pin chamber, wherein each crosses a shear line, and is linearly displaceable along said pin chamber, each standard pin assembly comprising a tumbler pin, a driver pin and a biasing spring, arranged so as to define a locked cylinder position, in which said driver pin extends beyond the shear line, preventing rotation of the cylinder plug, said tumbler pin being positioned opposite said driver pin, within said pin chamber, at least one pin assembly, modified to prevent impact-driven manipulation of said locks, said at least one modified pin assembly comprising:

a modified pin set comprising a tumbler and driver, being adapted so as to alter the magnitude of its response to an impact-driven blow applied to said tumbler pin, relative to the magnitude of the response of the standard pin assemblies contained in said common cylinder lock, such that when said tumbler pin is linearly displaced in response to an impact-driven blow of a given intensity, a portion of said impact-driven blow intensity is transmitted to said driver pin, causing it to be linearly displaced, as well, and while said standard pin assemblies clear the shear line, said driver pin of said modified pin set continues to block the shear line, consequently preventing unauthorized manipulation of said cylinder lock.

In the preferred embodiment, the modified pin assembly, containing a tumbler pin and a driver pin, is adapted so as to alter linear displacement thereof by forming a recession in one of the pins contained in the pin assembly, and an engagement means, in the other of the pins, for engaging the recession. Thus, when an impact-driven blow of a given intensity is applied so as to linearly displace the tumbler and driver pins, the pin engagement means engages the pin recession, strongly binding the tumbler and driver pins together, thereby, blocking the shear line and, consequently, preventing unauthorized manipulation of the common cylinder lock.

To ensure an optimum binding of the tumbler and driver pins together, the pin with the recession is made of a softer material than the pin with the pin engagement means. The engagement of tumbler and driver pins can be achieved by providing a flexible slotted tail section as part of the pin engagement means. In addition, the edge of the tail section is formed as a mushroom head, and the pin recession is conical in shape. These structural modifications reduce the machining tolerance requirements and the manufacturing cost, as well as ensuring optimum binding.

The mushroom head edge of the tail section plays three roles:

- It prevents the collar from escaping, even when the spring is exerting force, since the mushroom head blocks its movement since the head's diameter is greater than the diameter of the hole in the collar.
- When the impact-driven blow is delivered to the pin assembly, the mushroom head edge facilitates the entry of the flexible slotted tail section into the recession, whose diameter is smaller than its own, effectively trapping it in the recession.
- The mushroom head serves, in conjunction with other features, as a means of releasing the binding between the pins.

Other features and advantages of the invention will become apparent from the drawings and the description contained herein below.

BRIEF DESCRIPTION OF THE DRAWINGS

For a better understanding of the invention, reference is made to the accompanying drawings, in which like numbers designate corresponding elements or sections throughout, and in which.

DETAILED DESCRIPTION OF THE PREFERRED EMBODIMENTS

Figure 1:
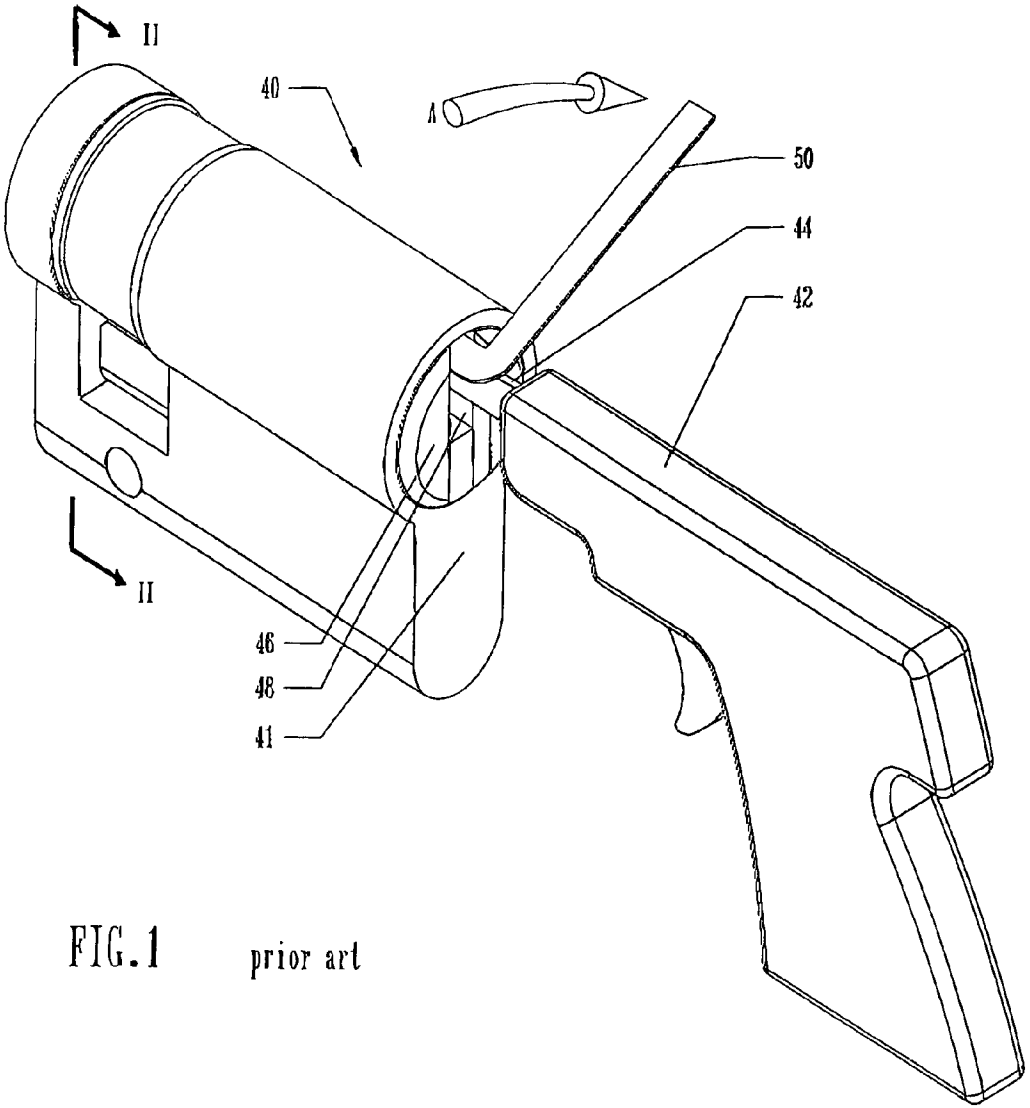
FIG. 1 prior art
FIG. 1 presents a perspective view of a prior art common cylinder lock, illustrating manipulation of the lock using a Blowgun inserted into the keyway of the lock.

Referring to FIG. 1, there is shown a cylinder lock 40 and corresponding plug 46, constructed and operated, in accordance with the principles of a common cylinder lock. Cylinder lock 40 has a cylinder housing 41, which defines a bore, within which a plug 46 is deployed. Plug 46 defines a keyway 48. Arrow A indicates the direction of the rotational force imparted by the tension rod 50 to the plug 46.

A tool for lock manipulation, known as a Blowgun 42 has a narrow, strong metallic portion 44, which has been inserted into the keyway 48 of the lock. An associated tension rod 50 has also been positioned in the keyway 48 so as to apply rotational force to the cylinder plug 46. When an impact-driven blow is transmitted by the Blowgun 42 to the driver pins, via the tumbler pins, and they are knocked out of position, clearing the shear line, the plug then rotates slightly, due to the force exerted by the tension bar. The rotation prevents the pins from returning to their locking position. The cylinder plug may now be freely rotated and the lock opened.

The pins in a standard pin assembly are comprised of metals whose specific gravity ranges between 7-9 grams/$cm^3$. The exact impact-driven blow intensity required to knock the standard pins out of position, clearing the shear line, is dependent on the specific gravity of the metal from which the pins are made.

Figure 2:
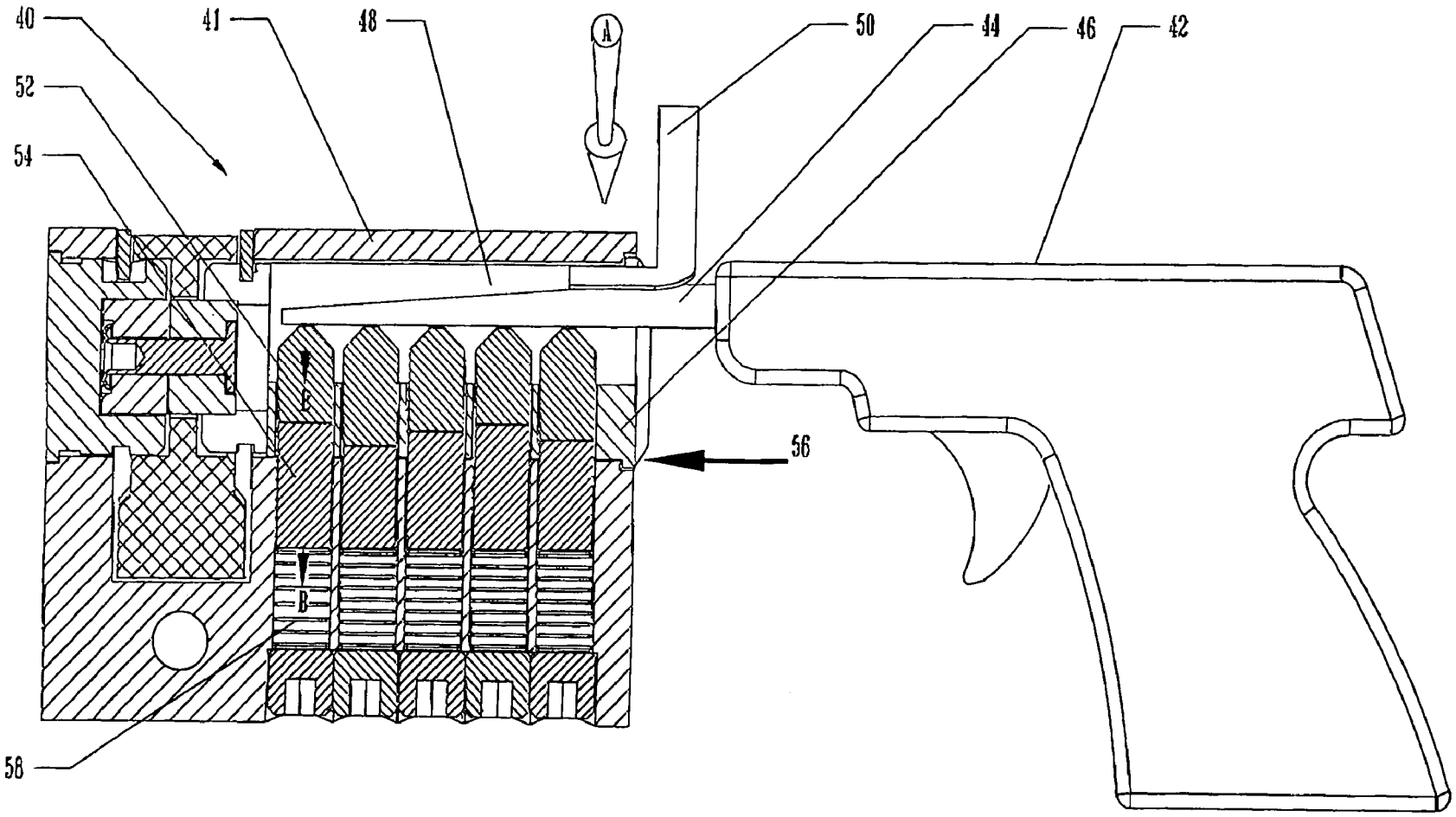
FIG.2 prior art
FIG. 2 is a cut away cross-sectional view, taken along section lines II-II, of the locked cylinder lock of FIG. 1, before an impact-driven blow has been delivered.

FIG. 2 is a cut away cross-sectional view, taken along section lines II-II, of the cylinder lock of FIG. 1. Tumbler pins 52 and driver pins 54 are shown in their locked position, blocking the shear line 56, so that the plug 46 cannot rotate. Biasing spring 58 is also shown.

The Blowgun 42 transmits the impact-driven blow in the direction of arrow B, onto the tumbler pin heads.

Figure 3:
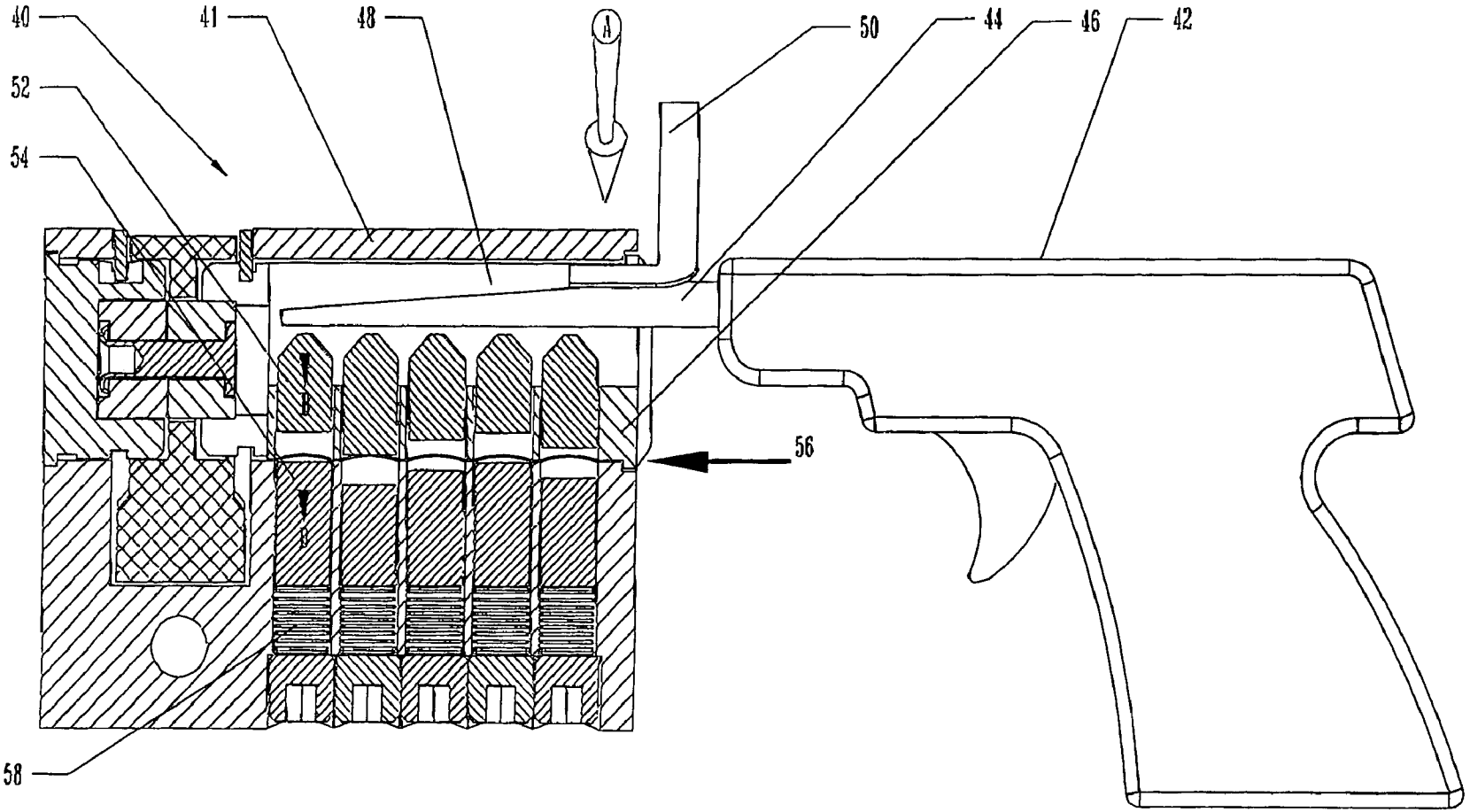
FIG.3 prior art
FIG. 3 schematically illustrates transmission of the impact-driven blow via the tumbler pins to the driver pin.

FIG. 3 schematically illustrates how an impact-driven blow B is transmitted via the tumbler pins 52 to the driver pins 54, clearing the shear line 56, to enable the plug's rotation.

Figure 4:
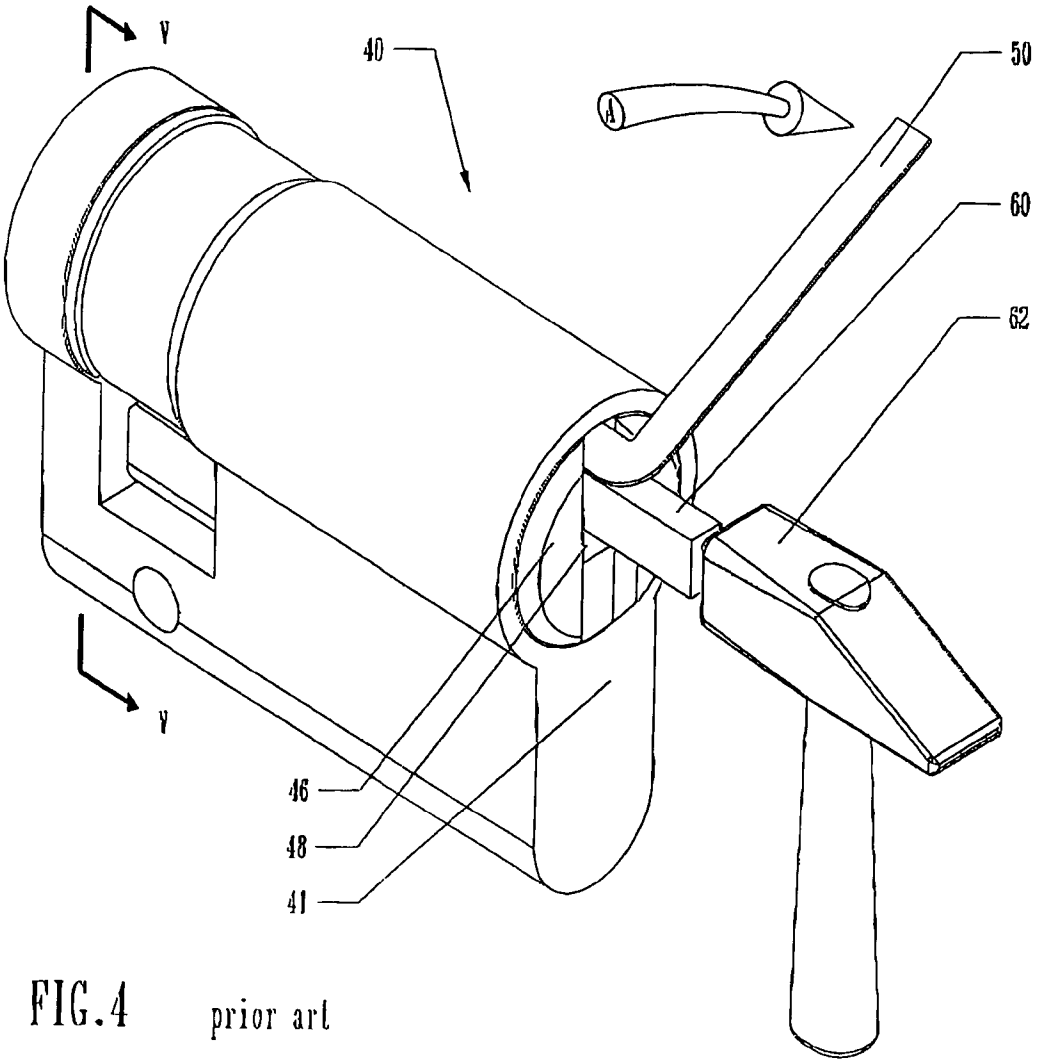
FIG.4 prior art
FIG. 4 presents a perspective view of a prior art common cylinder lock, in which a Bumpkey has been inserted into the keyway of the lock.

FIG. 4 presents a perspective view of a common cylinder lock, before a hammer impact-driven blow has been applied. A Bumpkey 60 has been inserted into the keyway 48 of the lock and its associated tension rod 50 has also been positioned in the keyway so as to apply rotational force to the cylinder plug 46. When the hammer 62 stroke force is transmitted to the driver pins, via the tumbler pins, and the driver pins art knocked out of position, clearing the shear line, the plug rotates slightly, due to the force exerted by the tension bar, and thereby prevents the pins from returning to their locking position. The cylinder plug may now be freely rotated and the lock opened.

Figure 5:
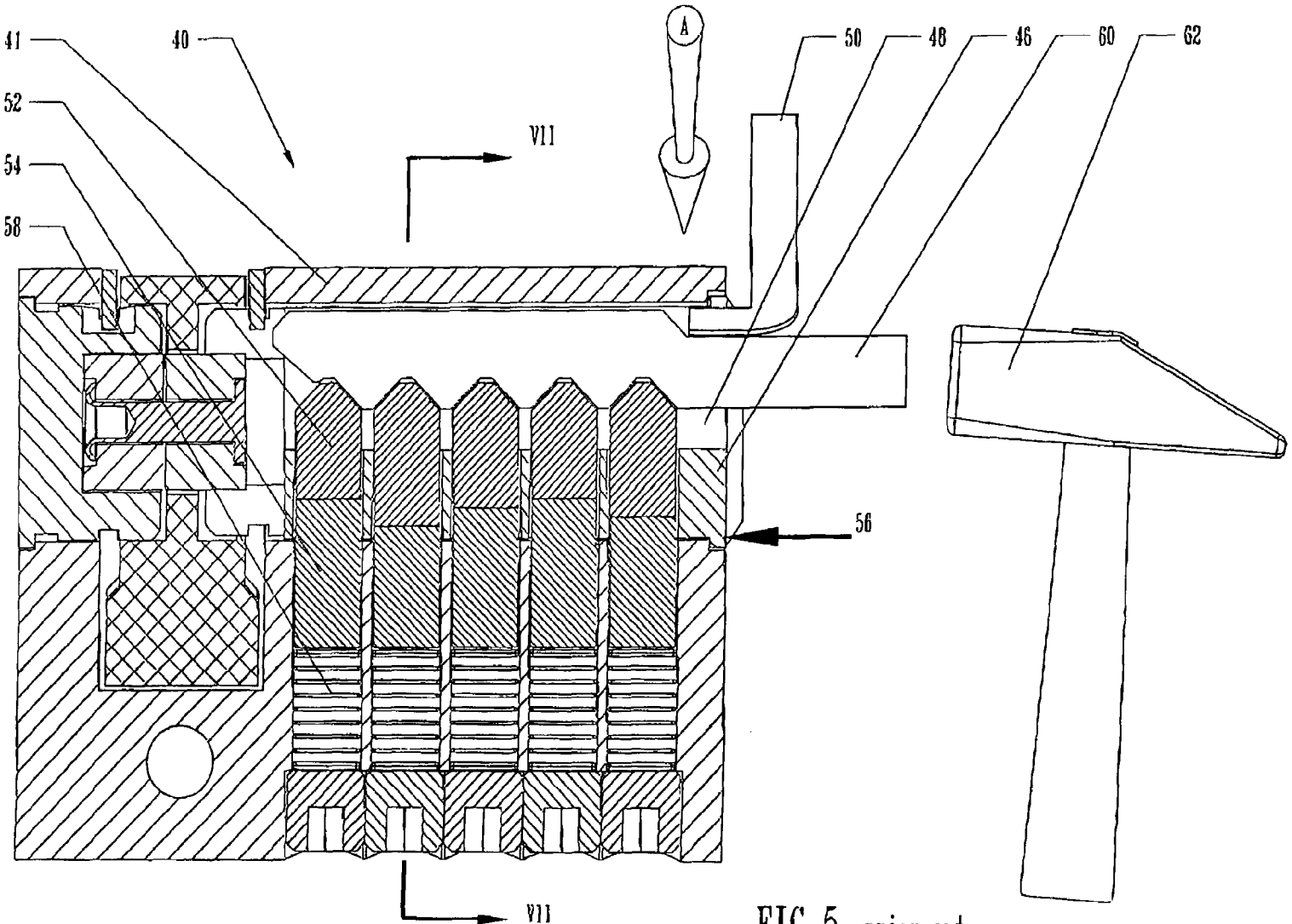
FIG.5 prior art
FIG. 5 is a cut away cross-sectional view, taken along section lines V-V, of the locked cylinder lock of FIG. 4, before the impact-driven blow has been delivered.

FIG. 5 is a cut away cross-sectional view, taken along section lines V-V, of the locked cylinder lock of FIG. 4, before the impact-driven blow has been delivered.

Figure 6:
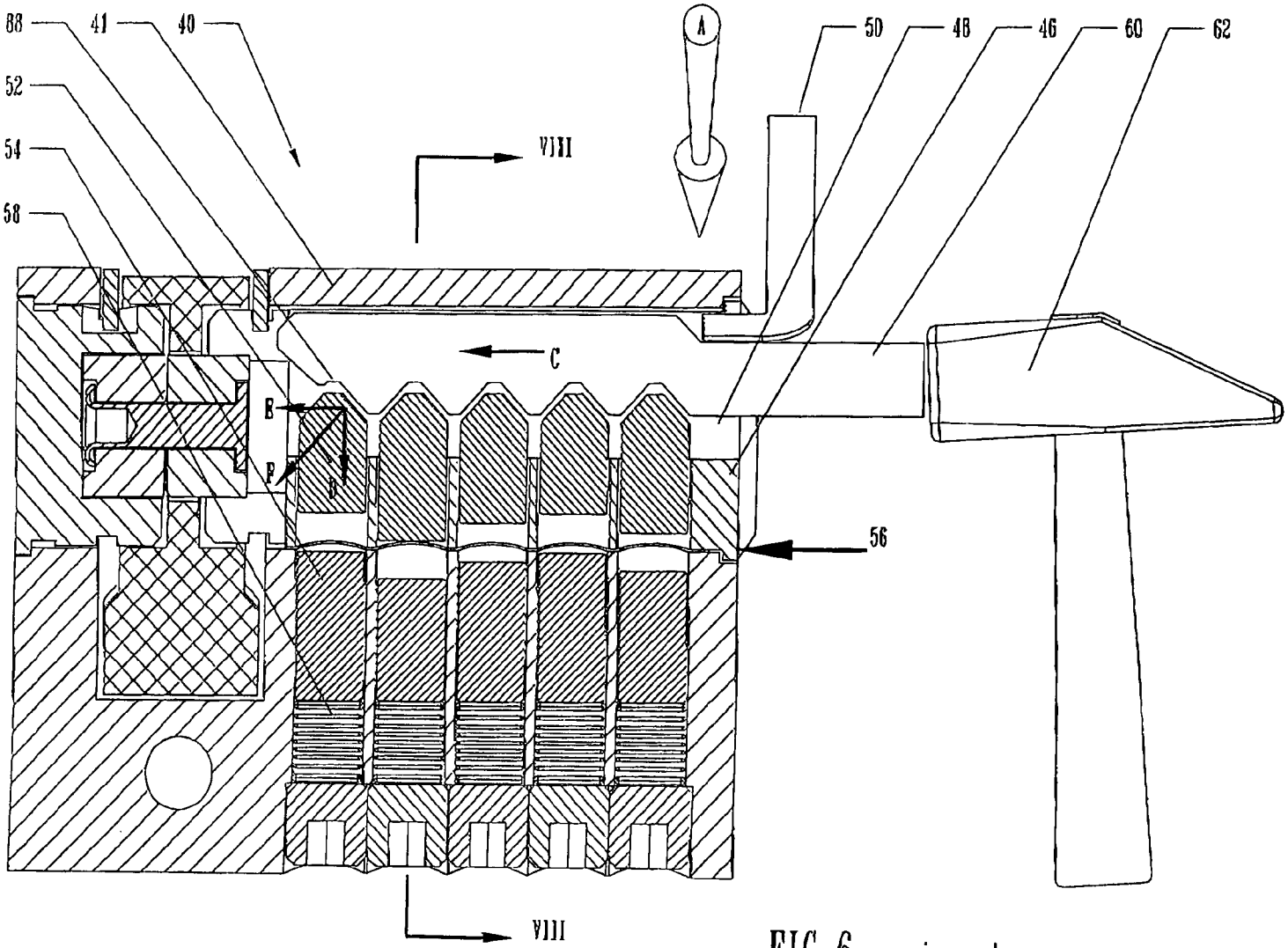
FIG.6 prior art
FIG. 6 schematically illustrates transmission of the impact-driven blow via the tumbler pins to the driver pins, to enable the plug's rotation.

FIG. 6 schematically illustrates transmission of the hammer 62 stroke force, via the Bumpkey 60 and the tumbler pins 52 to the driver pins 54, clearing the shear line 56, to enable the plug's rotation, The Bumpkey transmits an impact-driven blow in the direction of arrow C, whereas the direction required is shown by arrow D. Due to the angular structure of depressions 88, the impact-driven blow is distributed into three sub-vectors E, F, and D. The pin chamber walls do not permit the propagation of vectors E and F. Only vector D is propagated.

Figure 7:
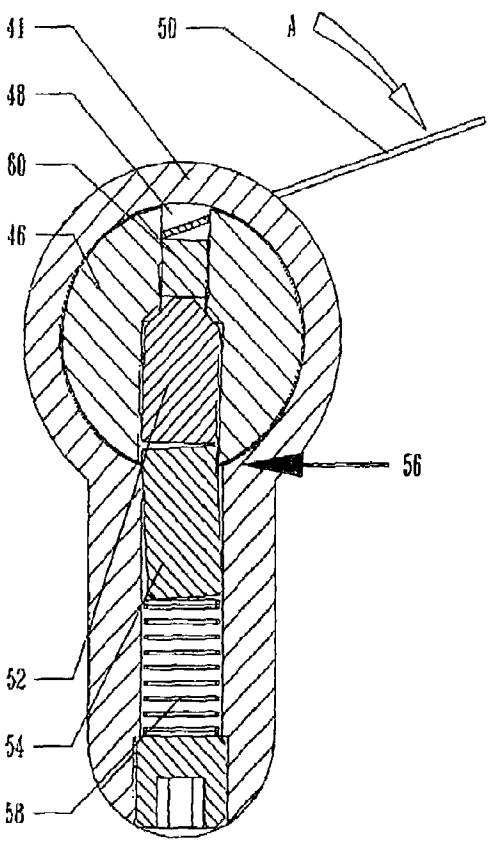
FIG.7 prior art
FIG. 7 is a cross-sectional view, taken along section lines VII-VII of FIG. 5.

FIG. 7 is a cross-sectional view, taken along section lines VII-VII of FIG. 5. It schematically illustrates the positioning of the tension rod 50 in the keyway 48 so as to apply rotational force to the cylinder plug 46, before a hammer impact-driven blow has been applied.

Figure 8:
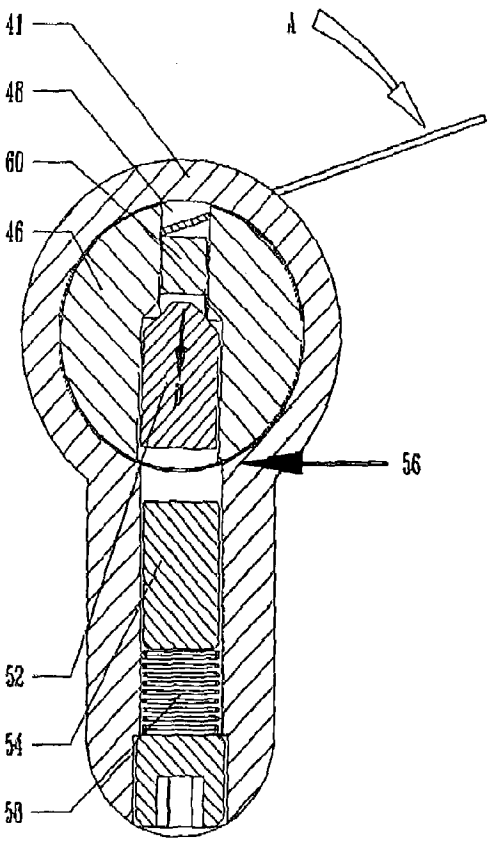
FIG.8 prior art
FIG. 8 is a cross-sectional view, taken along section lines VIII-VIII of FIG. 6, schematically illustrating the movement of the tumbler and driver pins.

FIG. 8 is a cross-sectional view, taken along section lines VIII-VIII of FIG. 6, schematically illustrating the movement of the tumbler and driver pins, clearing the shear line 56, right after an impact-driven blow D has been transmitted.

Figure 9:
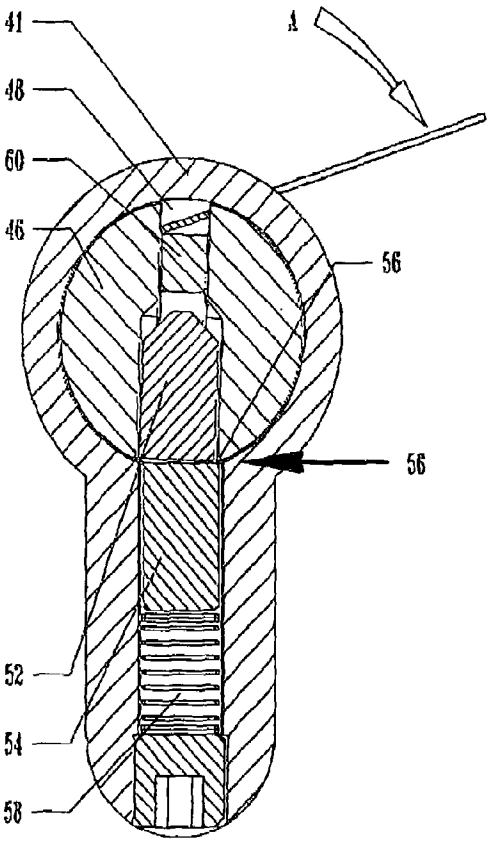
FIG.9 prior art
FIG. 9 is the same cross-sectional view as in FIG. 8, schematically illustrating rotation of the plug.

FIG. 9 is the same cross-sectional view as in FIG. 8, an instant after the pin attempts to return to its previous location, schematically illustrating rotation of the plug 46, as indicated by arrow A, thereby preventing the pins from returning to their locking position. The cylinder plug may now be freely rotated and the lock opened.

Figure 11:
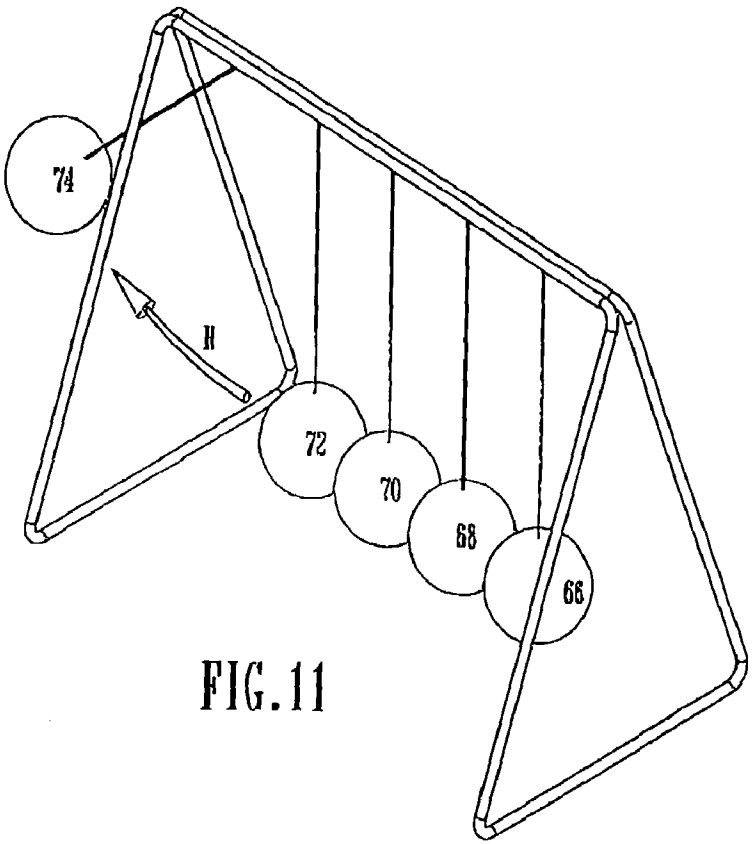
FIGS. 10-16 illustrate the operating stages of a well known device for demonstrating transfer of waves in material, also known as impact and momentum.
Figure 10:
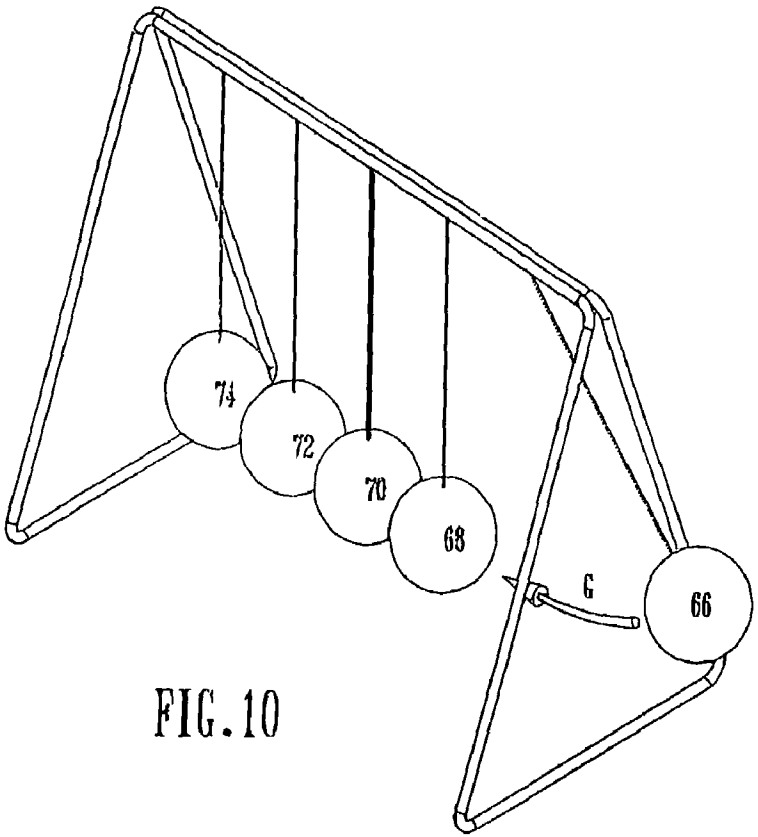

FIG. 10 illustrates a well-known device for demonstrating transfer of waves in material, also known as the impact and momentum phenomenon, in which five steel balls are hung in a row. Ball 66 is shown positioned so as to strike ball 68 with force G, as shown by the arrow, FIG. 11 depicts the situation after ball 66 has struck ball 68. Balls 70 and 72 appear to have remained essentially in place, whereas ball 74 has been displaced by a force H to a height essentially equivalent to that to which ball 66 had been raised before its release.

Figure 12:
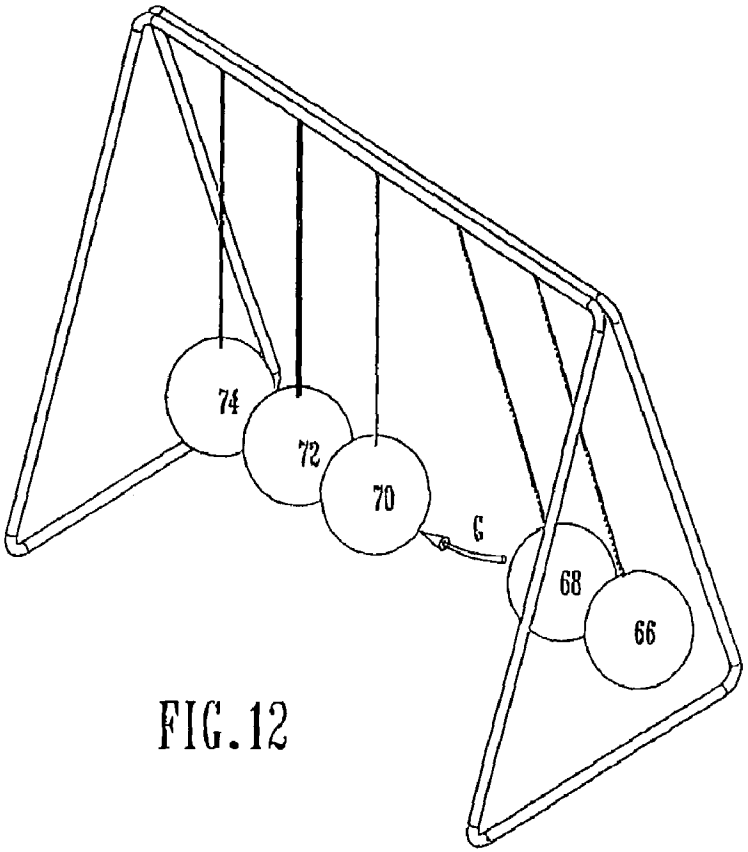

FIG. 12 illustrates the same device in which five steel balls are hung in a row. However, in this instance two balls 66 and 68 are released simultaneously, Here too the force is shown by arrow G.

Figure 13:
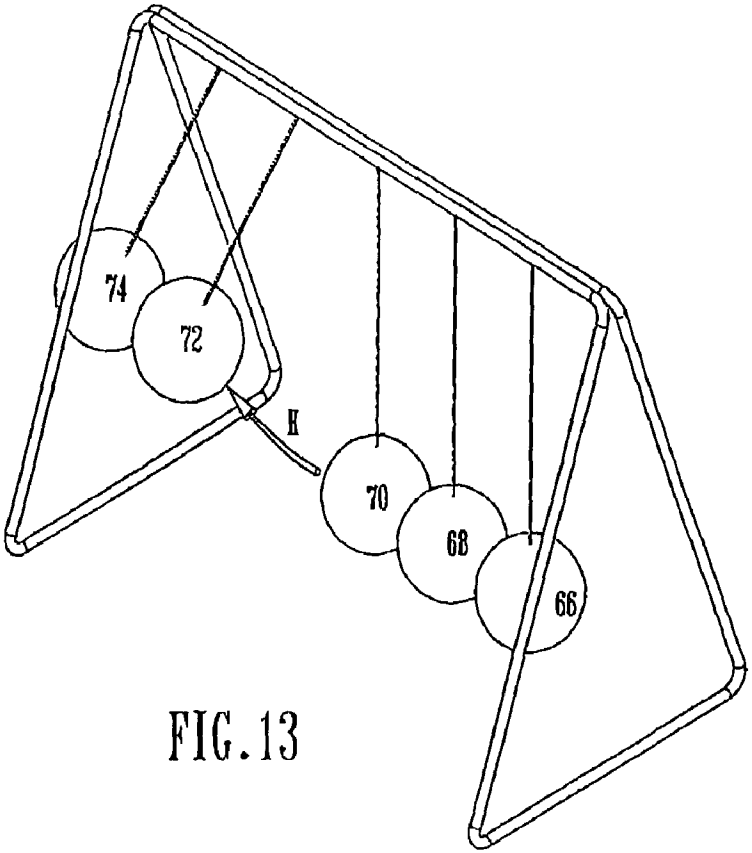

FIG. 13 depicts the situation after balls 66 and 68 have struck ball 70. Ball 70 appears to have remained essentially in place, whereas balls 72 and 74 have been displaced by a force H to a height essentially equivalent to that to which balls 66 and 68 had been raised before their release.

Figure 14:
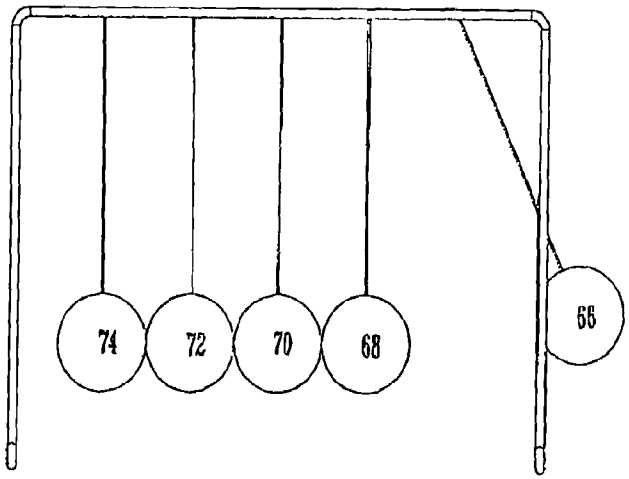

FIG. 14 provides a front view of the device, showing ball 66 positioned for release.

Figure 15:
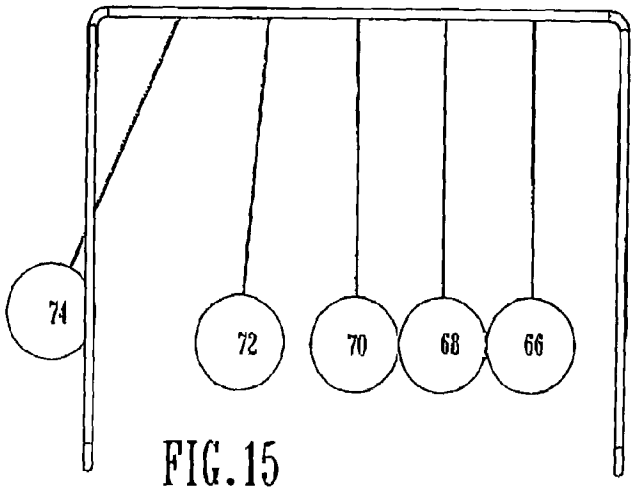

FIG. 15 shows a front view of the device, after ball 66 has struck ball 68. Careful inspection reveals that not only ball 74 has moved. Ball 72 has also moved, although not as much as ball 74.

Figure 16:
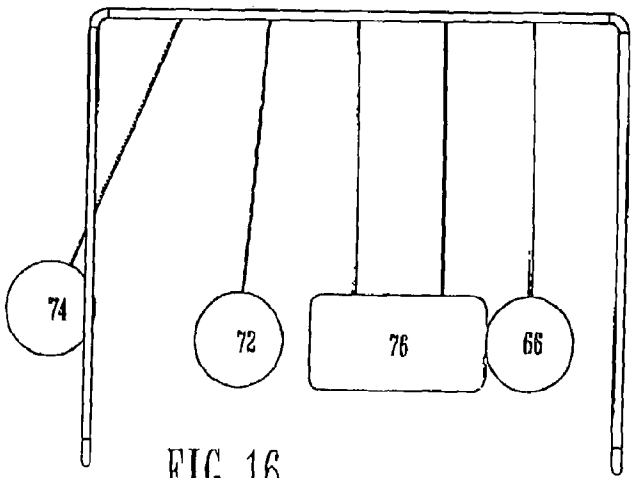

FIG. 16 depicts a variation of the device, in which balls 68 and 70 have been lumped into bar 76. Here also, it may be seen that after ball 66 struck bar 76, balls 72 and 74 have been displaced, ball 74 much more than ball 72.

FIGS. 10-16 illustrate the well-known physical phenomenon, impact and momentum, wherein are demonstrated physical laws, known and for the most part predictable, which have been used, in this example, to create a device. These same principles underlie the lock manipulation methods, illustrated in the preceding and following figures, known as the Blowgun and Bumpkey methods.

FIGS. 17-32 reveal in detail utilization of these same physical principles in an experiment to manipulate cylinder locks in an unauthorized way. Based on a thorough understanding of the phenomenon, a method of preventing such unauthorized manipulation of cylinder locks has been developed.

In FIGS. 17-28, a cylinder lock 40 is shown with five pin chambers, indicated by arrows S, T, U, V and Z. In each pin chamber there is a pin assembly that comprises a tumbler pin 52, a driver pin 54 and a biasing spring 58. There are differences in the pins aside from their lengths.

Figure 17:
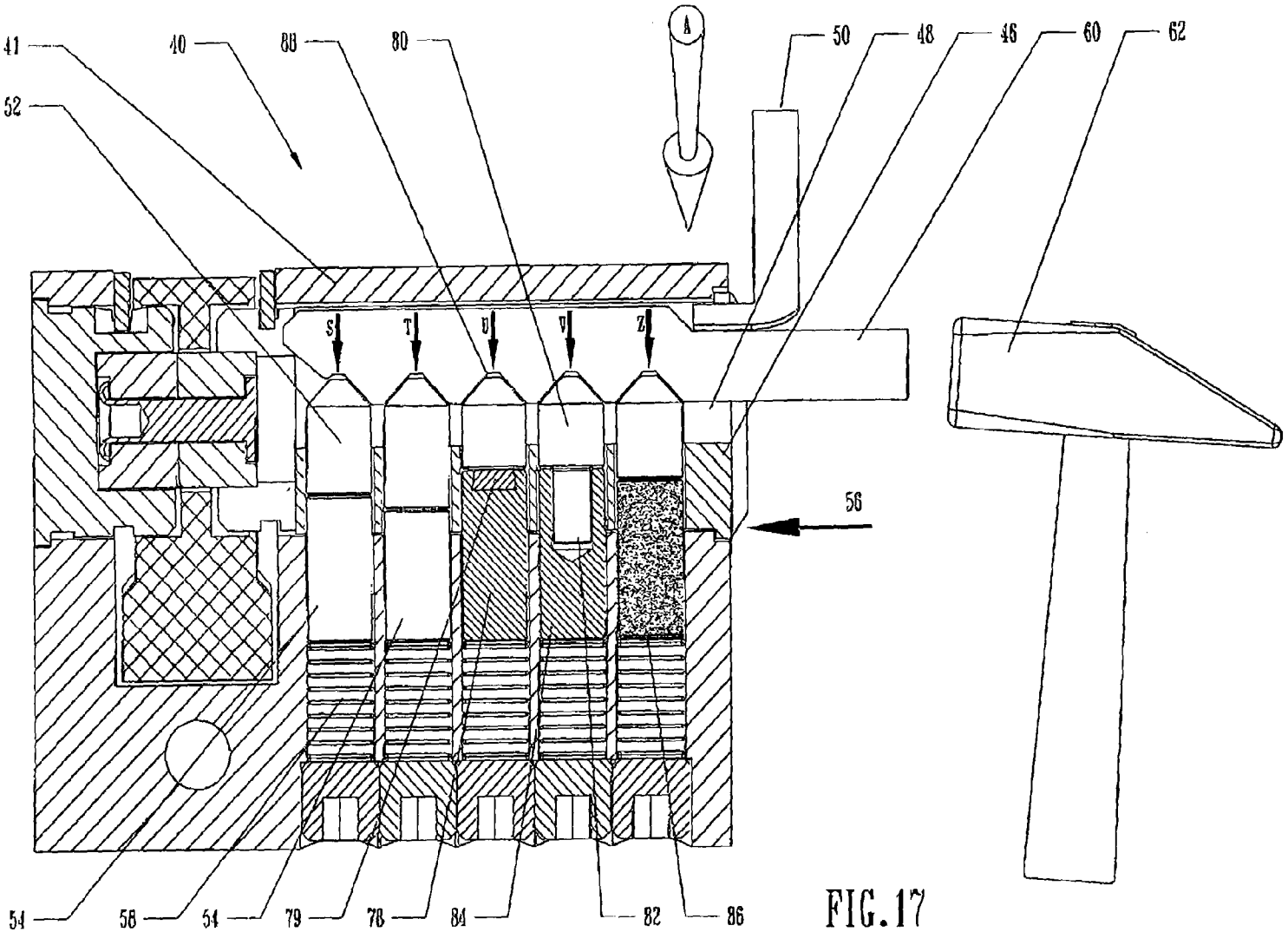
FIG. 17 presents a partial cross-section along a cylinder lock, featuring pins composed of different materials, having various response properties.

FIG. 17 presents a partial cross-section along cylinder lock 40, featuring pins composed of different materials having various response properties to an applied impact-driven blow. As shown, a Bumpkey 60 has been inserted into the keyway and its associated tension rod 50 has also been positioned in the keyway so as to apply rotational force to the cylinder plug.

The pin assemblies in chambers S and T contain standard pins, a tumbler pin 52 and a driver pin 54. In chamber U, a driver pin 18 has at its end a pad of energy absorbing material, such as Lead, at the point of contact between said driver pin 54 and said tumbler pin 52. In chamber V, a tumbler pin 80 is made of a magnetic material such as Martensitic stainless (400 series) and a magnet 82 is inserted in the driver pin 84. Alternately, all driver pin 84 could be a magnet, or 80 could contain or be the magnet and 84 could be made of the magnetic material, In chamber Z, the driver pin 86 is made of a dense metal, such as Tungsten or Tungsten Carbide, whose specific gravity is very high.

At this point, the following analogy associating the elements of the device for demonstrating transfer of waves in material, shown in FIGS. 10-16, and the Bumpkey-Cylinder Lock systems is useful:

Hammer 62=Ball 66
Bumpkey 60=Bar 76
Tumbler Pins 52 (and its variations)=Ball 72
Driver Pins 54 (and its variations)=Ball 74

Figure 18:
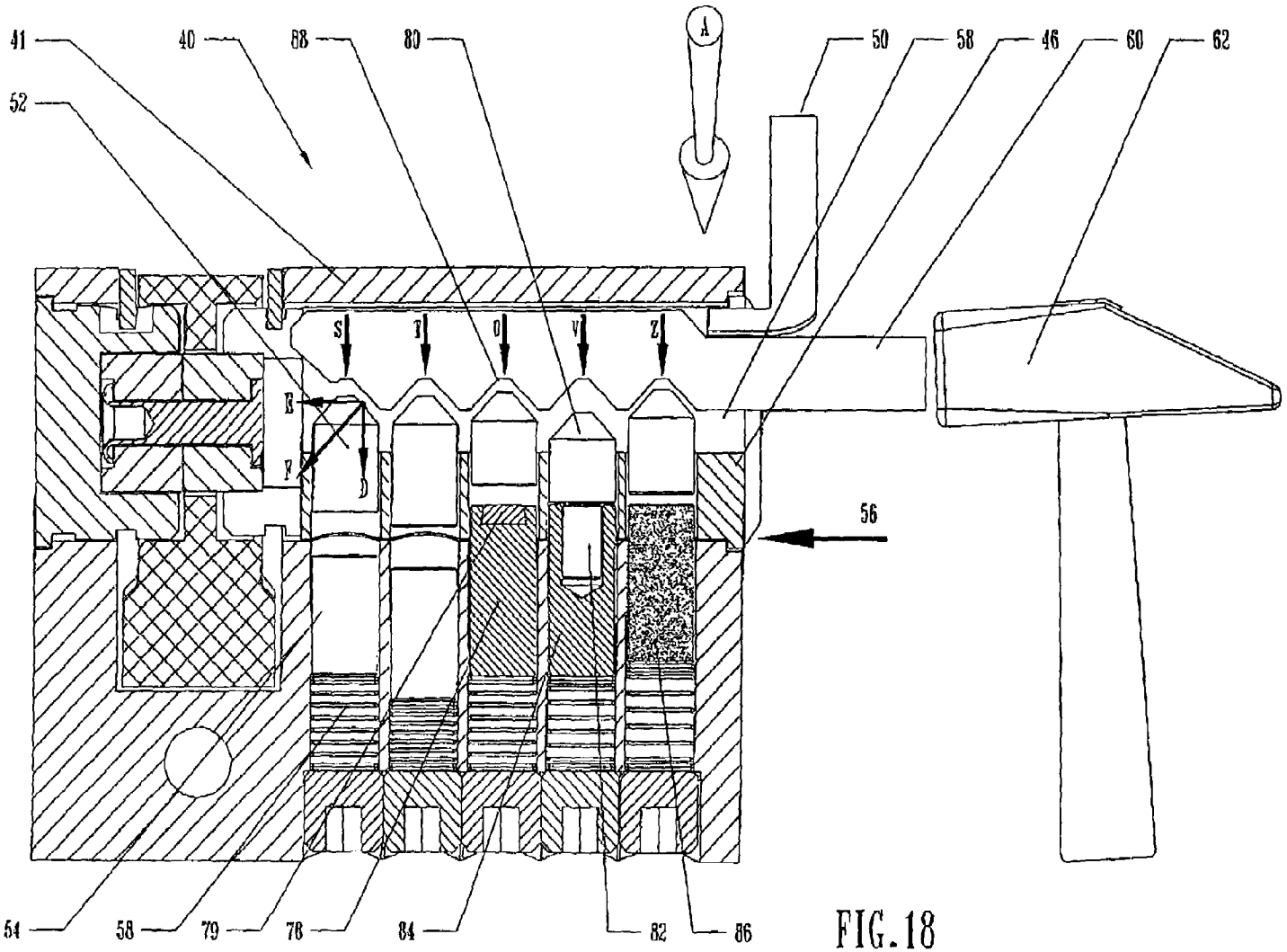
FIG. 18 shows a sectional view of FIG. 17, immediately after the hammer has struck the Bumpkey with an intensity normally required to unlock the lock.

FIG. 18 shows a sectional view of FIG. 17, at the point in time, in the experiment, immediately after the hammer 62 has struck the Bumpkey 60 with the controlled intensity normally required to unlock the lock. The depressions 88 along the length of the Bumpkey 60 distribute the applied force in an even manner to the heads of the tumbler pins 52. Each distributed portion of the applied force may be viewed as being comprised of the force vectors shown by arrows FED. Vector D is transferred to the driver pins 54. Both the tumbler pins and the driver pins move from their locking positions in the direction indicated by arrow D. The driver pins move more than do the tumbler pins, as had been seen with the analogous elements in FIGS. 14-16, i.e. balls 72 and 74.

The events that transpired, during the experiment, in each of the pin chambers are discussed below:

In chamber S, the standard driver pin 54 moved from its locking position and cleared the shear line 56.

In chamber T, the standard driver pin 54 moved from its locking position and cleared the shear line 56.

In chamber U, driver pin 78 has at its end a pad of energy absorbing material 79, such as Lead, at the point of contact with the tumbler pin 52. This material absorbs a large percentage of the applied impact-driven blow's intensity and energy, and therefore, driver pin 78 moves less than standard driver pins 54, such as those located in pin chambers S and T. In addition, driver pin 78 is positioned to extend further in the direction of the plug, and consequently, the shear line is still blocked. Additional attempts at dislodging these pins, so as to clear the shear line were successful. More time and effort were required to dislodge these pins.

In chamber V, a tumbler pin 80 is made of a magnetic material such as Martensitic stainless (400 series) and a magnet 82 is inserted in the driver pin 84. This combination effectively forms a unified object with respect to the impact and momentum phenomenon. As a result, after receiving the applied impact-driven blow, the two pins travel together, and due to their combined length and weight do not clear the shear line. It should be noted that, magnet notwithstanding, when the correct key is inserted, the cylinder plug may be easily rotated. In addition, after additional attempts, the cylinder lock was unlocked, usually by employing a higher intensity of applied impact, as shown in FIG. 19.

In chamber Z, the driver pin 86 is made of a dense metal, such as Tungsten or Tungsten Carbide, whose specific gravity is very high. The applied impact-driven blow is insufficient to displace the driver pin and clear the shear line. The shear line is still blocked.

Figure 19:
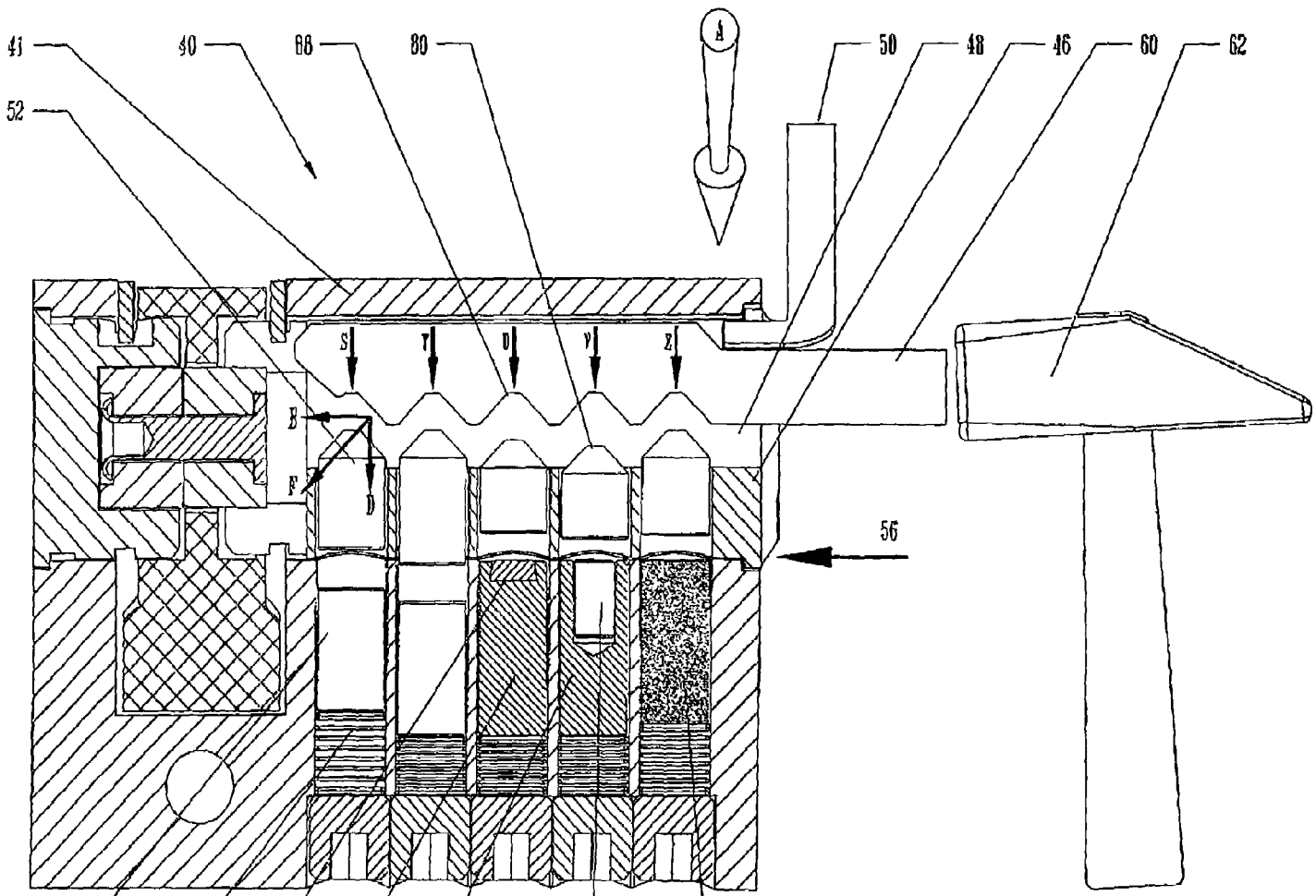
FIG. 19 shows the sectional view of FIG. 17, immediately after the hammer has struck the Bumpkey with an intensity greater than the intensity normally required to unlock the lock.

FIG. 19 shows a sectional view of FIG. 17; immediately after the hammer has struck the Bumpkey with an intensity greater than the normal intensity applied to unlock the lock in FIG.18. The driver pins in pin chambers S, U, V and Z have all cleared the shear line. The driver pin in chamber T is displaced, however, the tumbler pin, which is the longest tumbler pin in this lock, is displaced so as to reach and block the shear line.

As can be seen in FIG. 9, it is possible, however, that the tumbler pin will not reach and block the shear line, because the plug has been rotated slightly, due to the force exerted by the tension bar. The tumbler pin will be caught on the corner of the plug and pin chamber, and not reach and block the shear line.

Figure 20:
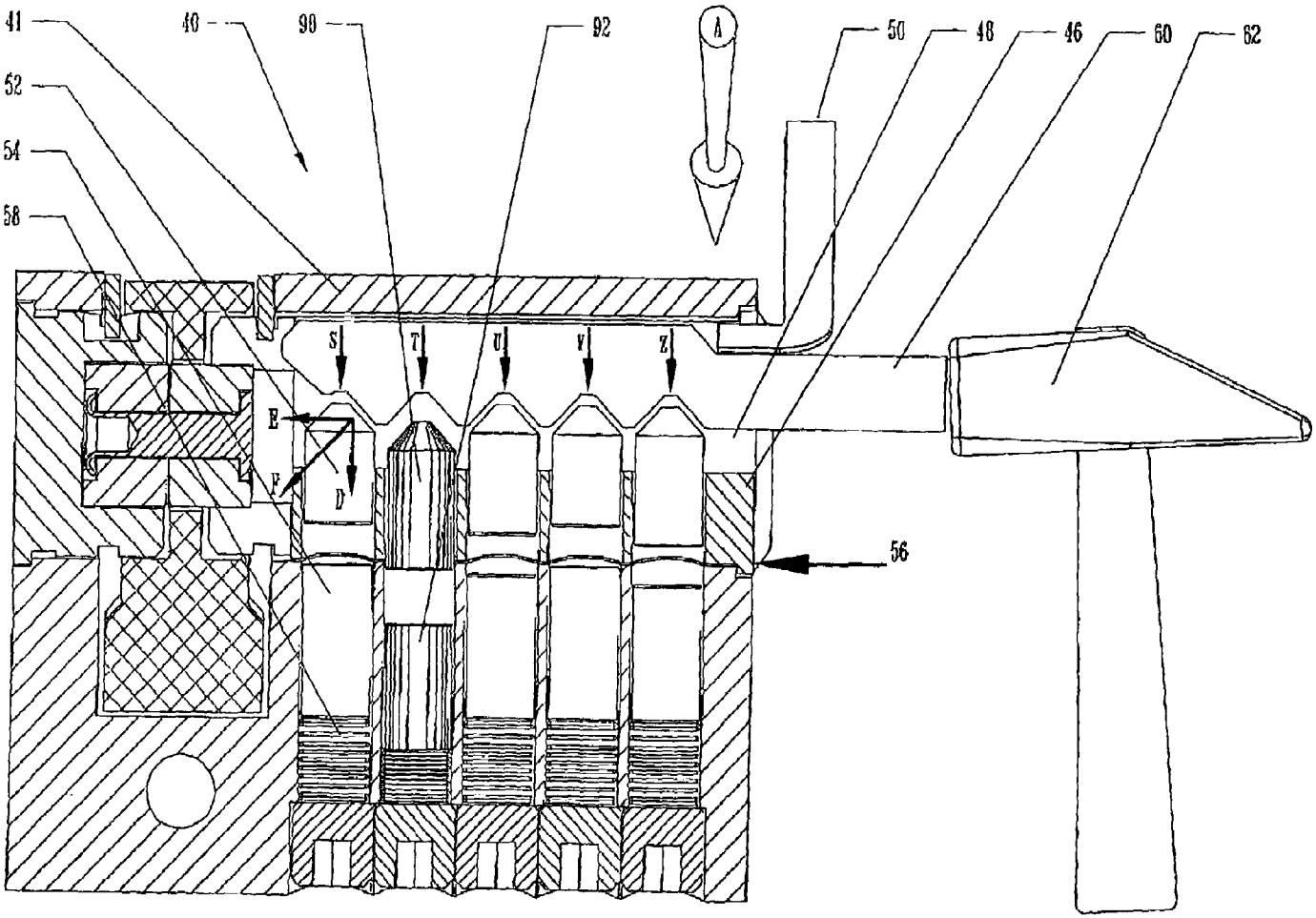
FIG. 20 presents a partial cross-section along a cylinder lock, having a plurality of standard pin assemblies, and one modified pin assembly, made of light metal.

FIG. 20 presents a partial cross-section along a cylinder lock, having a plurality of standard pin assemblies, and one modified pin assembly, in which the pins of the modified pin assembly, 90 and 92, are made of a light metal, such as Titanium, whose specific gravity is very low. The driver pins in pin chambers S, U, V and Z have all cleared the shear line. Although the driver pin in chamber T is displaced and has cleared the shear line, the associated tumbler pin has also been displaced so as to reach and block the shear line.

Figure 21:
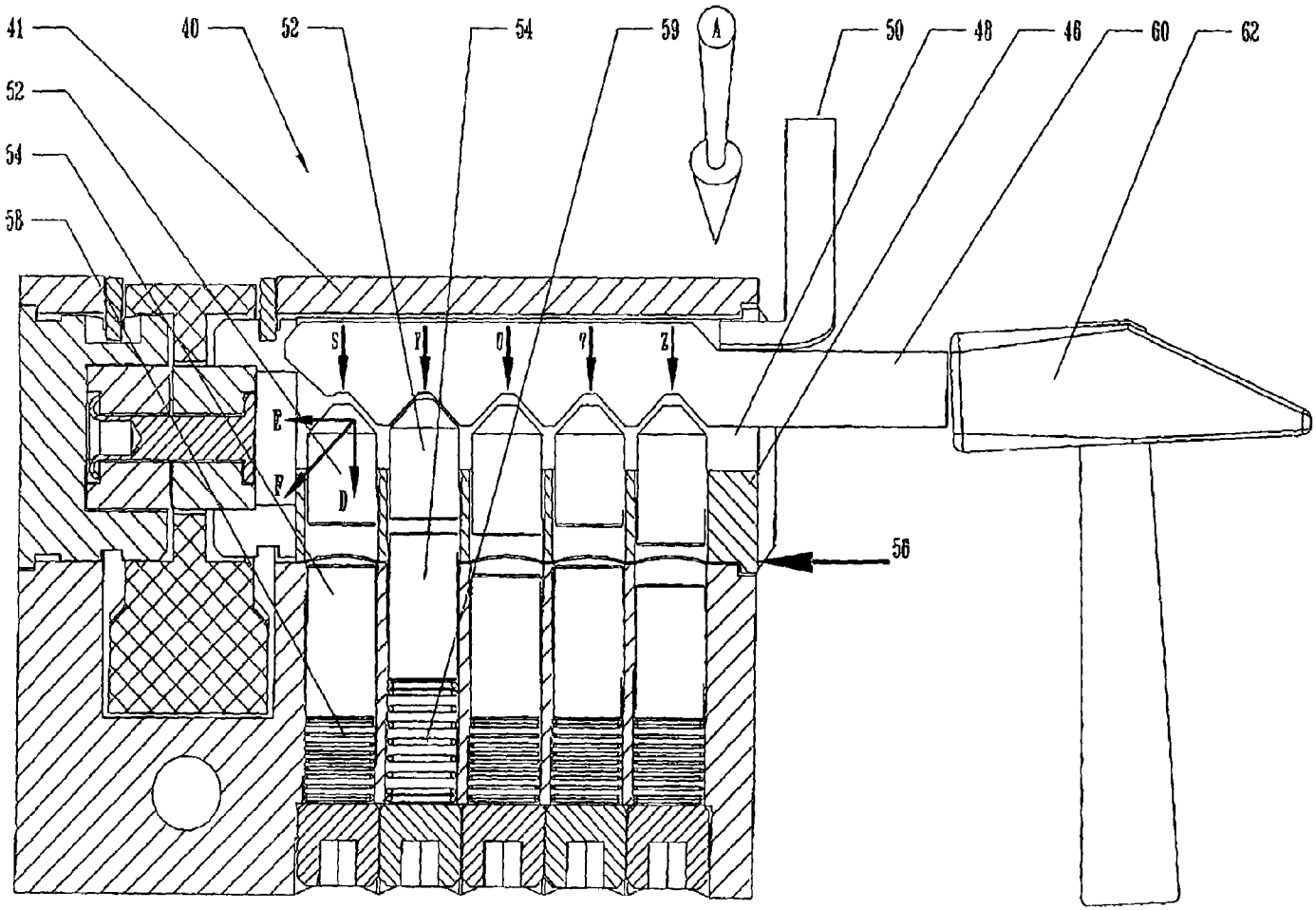
FIG. 21 presents a partial cross-section along a cylinder lock, having a plurality of standard pin assemblies, and one modified pin assembly, featuring a modified biasing spring.

FIG. 21 presents a partial cross-section along a cylinder lock, having a plurality of standard pin assemblies, and one modified pin assembly, featuring a modified biasing spring. As can be seen, it is also possible to attain different response properties to an applied impact-driven blow by modifying the strength properties of the biasing spring 59. This makes it more difficult to manipulate a common cylinder lock, as executed by the Bumpkey or Blowgun methods, but does not entirely prevent such manipulation.

In the preceding figures several modified pin assemblies were presented, including at least one standard driver pin. They each had different properties and moved differently in response to an applied force of a given intensity. By integrating, in a cylinder lock, at least two different pin types, of which one is standard, it becomes much more difficult, but not entirely impossible, to manipulate the lock, as executed by the Bumpkey or Blowgun methods. The following figures illustrate the preferred solution, in accordance with the principles of the present invention, for entirely eliminating the unauthorized unlocking of a cylinder lock, as executed by the Bumpkey or Blowgun methods.

Figures 22, 23:
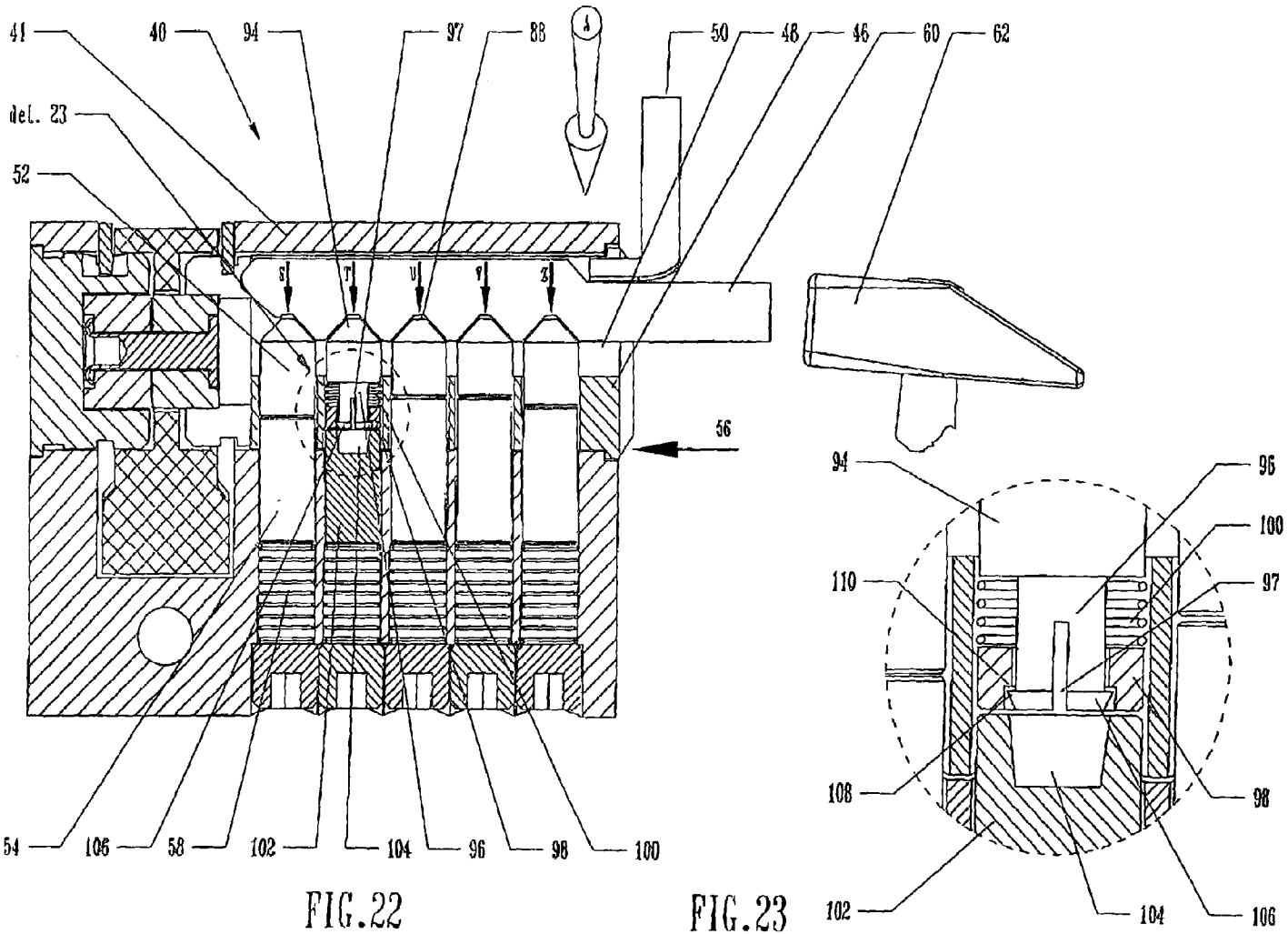
FIG. 22 presents a partial cross-section along a cylinder lock, featuring a modified pin assembly, adapted so as to alter linear displacement thereof, in accordance with the principles of the present invention.
FIG. 23 presents an enlarged cross-sectional view of the point of engagement of the pins in the pin assembly.

FIG. 22 presents a partial cross-section along a cylinder lock, featuring a modified pin assembly, constructed and operated, in accordance with the principles of the present invention. The modified pin assembly is adapted so as to alter linear displacement thereof by forming a recession in the driver pin, and an engagement means for engaging the recession in the tumbler pin. A Bumpkey 60 has been inserted into the keyway, and its associated tension rod 50 has also been positioned in the keyway so as to apply rotational force to the cylinder plug.

The sectional tumbler pin is comprised of a pin head 94, flexible slotted tail section 96 having slot 97, collar 98 and spring 100. Opposite the tumbler pin is located driver pin 102. A recession 104 is formed on the driver pin, with this recession set opposite the flexible slotted tail section 96 of the sectional tumbler pin. Spring 100 is stronger than biasing spring 58 and therefore, flexible slotted tail section 96 does not enter recession 104, thus not interfering with the rotation of the plug when the correct key is inserted.

FIG. 23 presents an enlarged cross-sectional view of the point of engagement of the pins in the pin assembly, as shown in detail 23 of FIG. 22. The edge 108 of the mushroom head 106, of flexible slotted tail section 96, sits on a ledge 110 formed within the hole of the collar 98. Although the spring 100 is exerting force on the collar 98, the mushroom head 106 prevents the collar from escaping, since the mushroom head diameter is greater than the diameter of the hole in the collar.

Figures 24, 25:
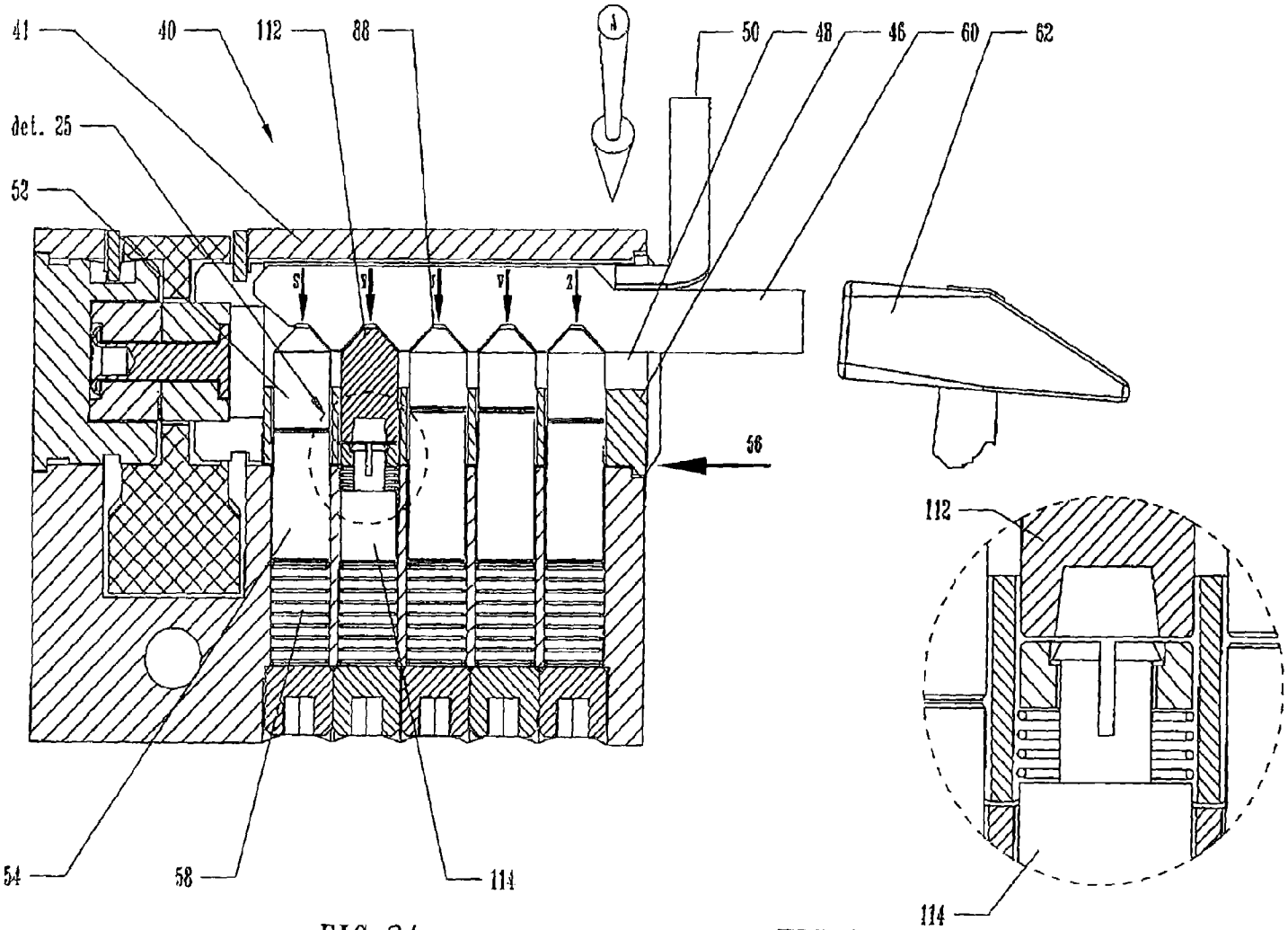
FIG. 24 presents a partial cross-section along a cylinder lock, featuring another type of modified pin assembly, adapted so as to alter linear displacement thereof, in accordance with the principles of the present invention.
FIG. 25 presents an enlarged cross-sectional view of the point of engagement of the pins in the pin assembly.
Figures 26, 27:
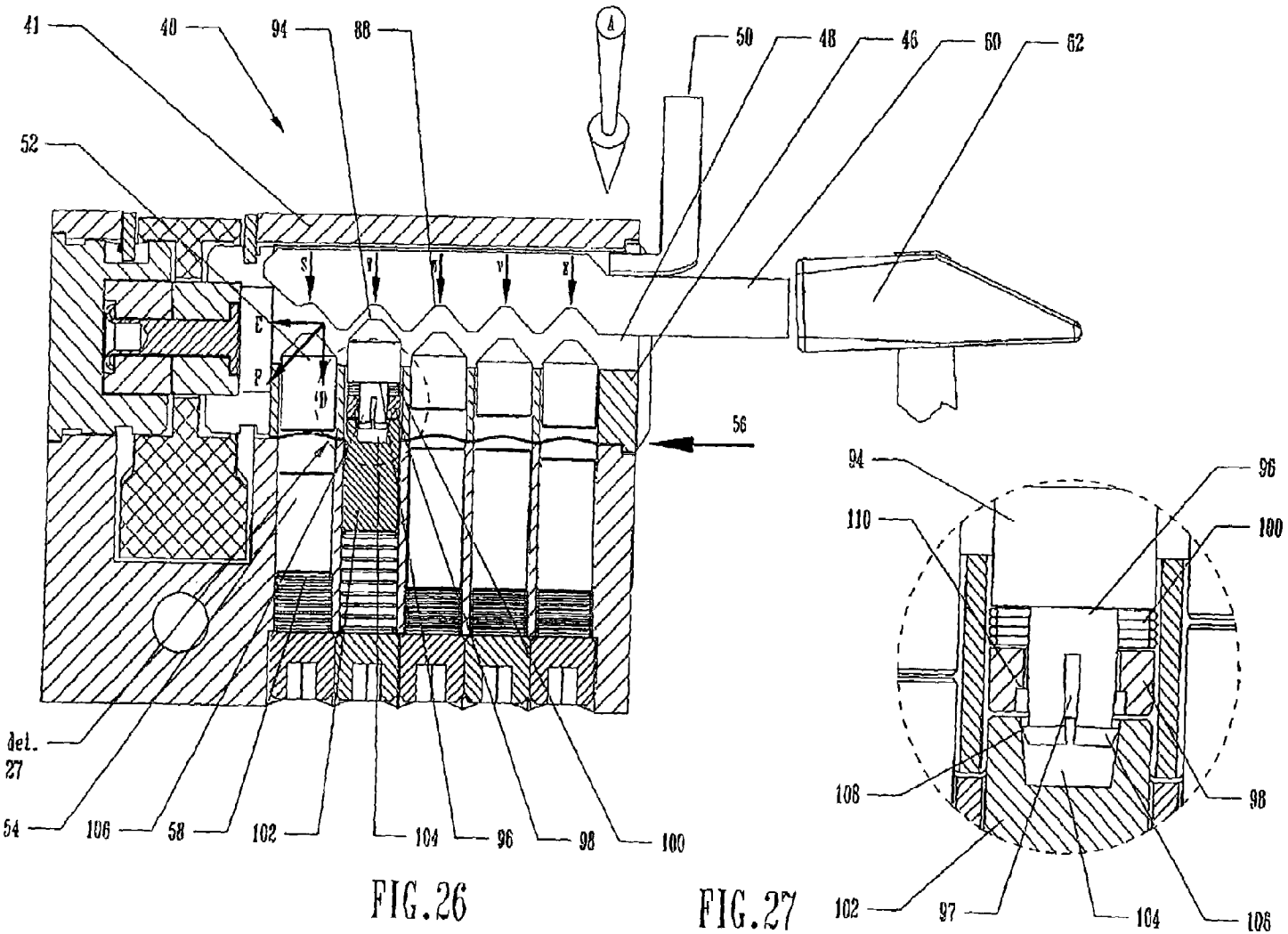
FIG. 26 shows the sectional view of FIG. 22, immediately after the hammer has struck the Bumpkey.
FIG. 27 presents an enlarged cross-sectional view of the point of engagement of the pins in the pin assembly, immediately after the hammer has struck the Bumpkey.

FIG. 24 presents a partial cross-section along a cylinder lock, featuring a modified pin assembly, constructed and operated, in accordance with the principles of the present invention. The modified pin assembly is adapted so as to alter linear displacement thereof, by forming a recession in the tumbler pin 112, and an engagement means for engaging the recession in the driver pin 114;

FIG. 25 presents an enlarged cross-sectional view of the point of engagement of the pins in the pin assembly, as shown in detail 25 of FIG. 24;

FIG. 26 shows the sectional view of FIG. 22, immediately after the hammer 62 has struck the Bumpkey 60. The driver pins in pin chambers S, U, V and Z are moved from their locking positions and clear the shear line. In chamber T, the sectional tumbler pin 94 moves from its locking position, depressing spring 100. The flexible slotted tail section 96 has become trapped in recession 104 and binds driver pin 102 and the tumbler pin 94. The shear line is blocked and the cylinder lock cannot be opened.

In the preferred embodiment, to ensure optimum binding of the tumbler and driver pins together, the driver pin is made of a softer material than the tumbler pin. The tail section of the tumbler pin is flexible due to the slot 97, the edge of the tail section is mushroom-headed and the driver pin recession is conical in shape. These structural modifications reduce the machining tolerance requirements and the manufacturing cost, as well as ensuring optimum binding.

FIG. 27 presents an enlarged cross sectional view of the point of engagement of the pins in the pin assembly, immediately after the hammer has struck the Bumpkey, as shown in detail 27 of FIG. 26. When the impact-driven blow is delivered to the pin assembly, the mushroom head 106 and the slot 97 facilitate the entry of the flexible slotted tail section 96 into the recession 104, whose diameter is smaller than its own. The edge 108 of the mushroom head 106 digs into the softer material of the driver pin, effectively trapping the tail section 96 in the recession.

Figures 28, 29:
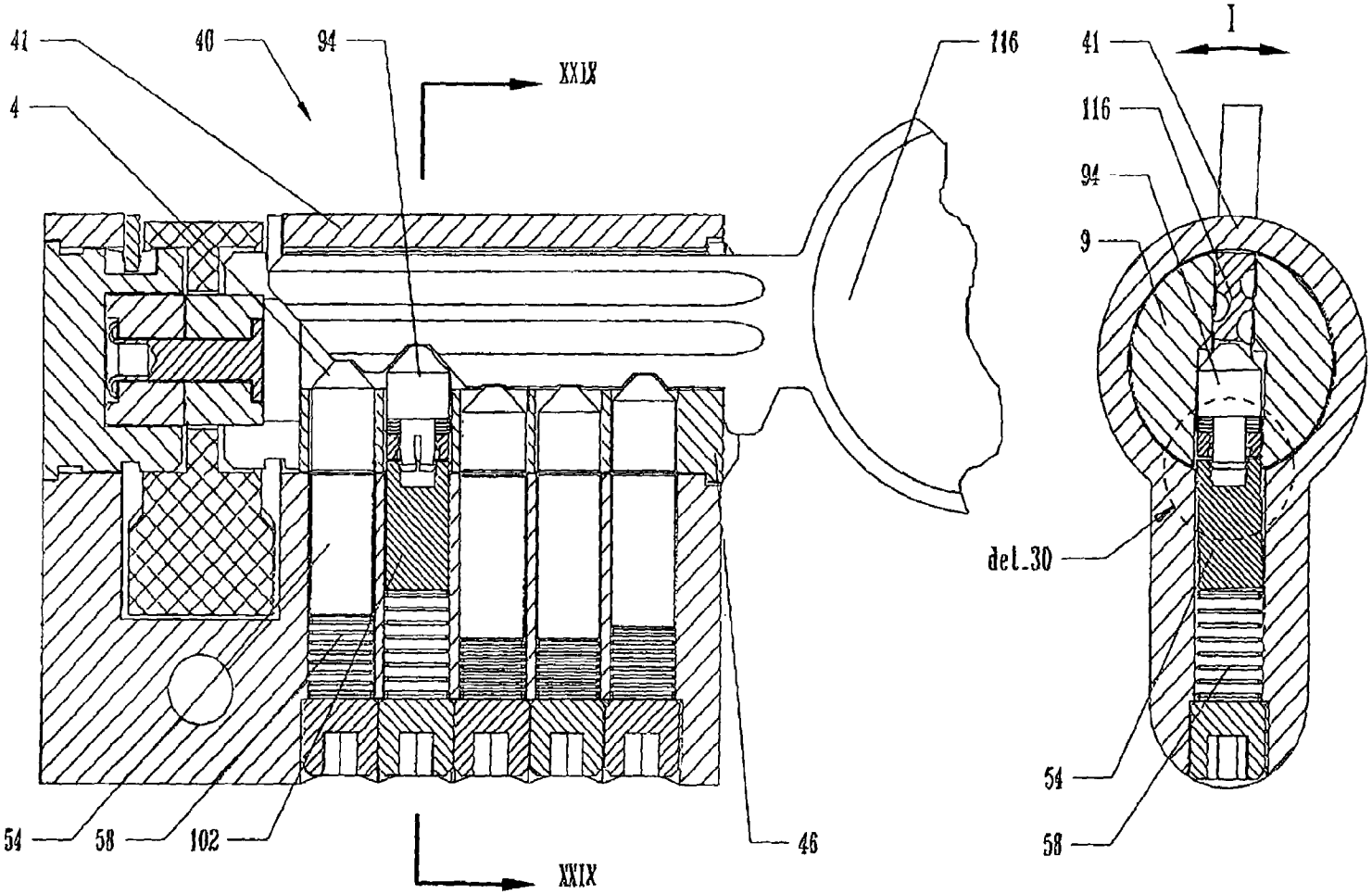
FIG. 28 is a sectional view of FIG. 26, showing use of the authorized key to release the modified pin assembly of the present invention.
FIG. 29 is a cross-sectional view taken along section line XXIX-XXIX of FIG. 28.

FIG. 28 is a sectional view of FIG. 26, showing that even though the authorized key 116 has been inserted, the lock can not be opened because the modified pin assembly of the present invention still blocks the shear line. The engaged tumbler and driver pins represent unauthorized manipulation of the lock, using a manipulation method based on the physical phenomenon of impact and momentum.

FIG. 29 is a cross-sectional view taken along section line XXIX-XXIX of FIG. 28, showing that when the authorized key is inserted and rotated from side to side vigorously in the directions indicated by arrow I, the binding of the pins featured in FIGS. 22-23 and FIGS. 26-29, is released, allowing the lock to be opened.

Figure 32:
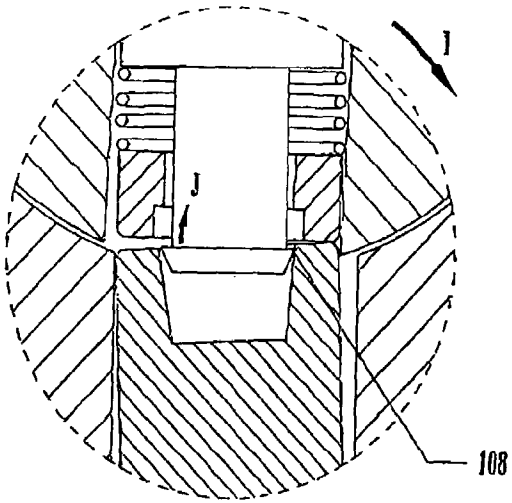
FIGS. 30-32 illustrate the technique of releasing the engaged pins of the modified pin assembly using the authorized key.
Figure 31:
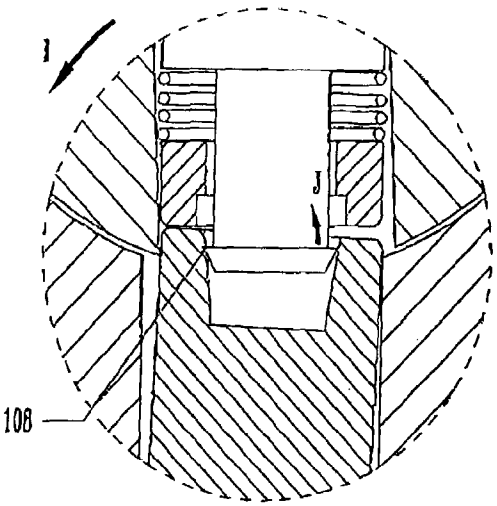
Figure 30:
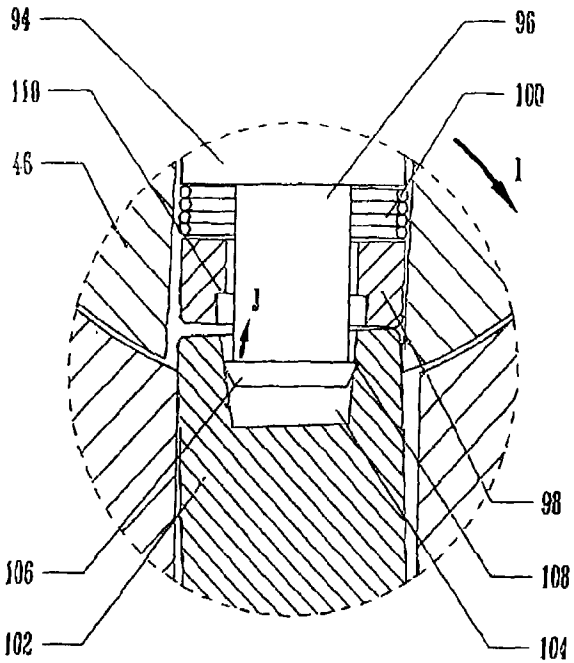

As illustrated in FIGS. 30-32, means are provided to enable release of the existing engagement between the tumbler and driver pins. In his example, these means include the gap provided between the pin assembly and the walls of the pin chamber, and the collar and spring arrangement, which together with vigorous rotation of the authorized key enable release of the engaged tumbler and driver pins.

FIG. 30 presents an enlarged cross-sectional view of detail 30 of FIG. 29 showing the point of engagement of the pins in the modified pin assembly,. The figure illustrates the application of a torque to the bond between sectional tumbler pin 94 and driver pin 102, as a result of the rotation of the plug 46 in the direction of arrow I. One edge 108 of the mushroom head 106 provides an axis of rotation for the opposing edge 108 of the mushroom head that is displaced out of the recession 104 in the direction indicated by arrow 3.

FIG. 31 depicts a situation identical to that shown in FIG. 30, however, with the direction of the rotation of plug 46 reversed. Another torque is applied to the bond between tumbler pin 94 and driver pin 102. The sectional tumbler pin, rotating on edge 108, in the direction indicated by arrow J, has advanced outwards in the process of its escape from recession 104.

FIG. 32 depicts a situation identical to that shown in FIG. 31, however, with the direction of the rotation of plug 46 once again reversed. Another torque is applied to the bond between sectional tumbler pin 94 and driver pin 102. The mushroom head 106 has almost been completely removed from recession 104. Spring 100 and collar 98 are assisting in this process of its escape from recession 104.

In summary, and as will be appreciated from the above description, the present invention provides a method and assembly for completely eliminating unauthorized manipulation of common cylinder locks, by using pin engagement means to strongly bind the tumbler and driver pins together, in response to an impact-driven blow, thereby blocking the shear line and maintaining the lock closed.

Having described the invention with regard to certain specific embodiments, it is to be understood that the description is not meant as a limitation since further modifications may now suggest themselves to those skilled in the art, and it is intended to cover such modifications, as fall within the scope of the appended claims.

I claim:

1. A modified pin assembly in a common cylinder lock, said cylinder lock having a body and cylinder plug containing a plurality of standard pin assemblies, each of said plurality of standard pin assemblies being disposed in a pin chamber, wherein each crosses a shear line, and is linearly displaceable along said pin chamber, each standard pin assembly comprising a tumbler pin, a driver pin and a biasing spring, arranged so as to define a locked cylinder position, in which said driver pin extends beyond the shear line, preventing rotation of the cylinder plug, said tumbler pin being positioned opposite said driver pin, within said pin chamber, wherein said modified pin assembly prevents impact-driven manipulation of said lock, said modified pin assembly comprising:

a modified pin set comprising a tumbler pin and driver pin, said modified pin set being provided with motion alteration means adapted so as to alter the magnitude of its response to an impact-driven blow applied to said tumbler pin, relative to the magnitude of the response of the standard pin assemblies contained in said common cylinder lock, such that when said tumbler pin is linearly displaced in response to an impact-driven blow of a given intensity, a portion of said impact-driven blow intensity is transmitted to said driver pin, causing it to be linearly displaced, as well, under influence of said motion alteration means, and while said standard pin assemblies clear the shear line, said driver pin of said modified pin set continues to block the shear line, consequently preventing unauthorized manipulation of said cylinder lock, wherein said motion alteration means of said modified pin assembly comprises a recession formed in one of said pins contained in said pin assembly, and a protrusion, in the other of said pins, for engaging said recession, such that when an impact-driven blow of a given intensity is applied so as to linearly displace said tumbler and driver pins, said pin protrusion engages said pin recession, strongly binding the tumbler and driver pins together.

2. The modified pin assembly of claim 1 wherein means are provided to enable release of said engaged tumbler and driver pins.

3. The modified pin assembly of claim 2 wherein said unauthorized manipulation is represented by said engaged tumbler and driver pins and said release of said engaged tumbler and driver pins indicates an attempted unauthorized manipulation.

4. A method for preventing unauthorized manipulation of a common cylinder lock, said common cylinder lock having a body and a cylinder plug containing a plurality of standard pin assemblies, each of said plurality of standard pin assemblies being disposed in a pin chamber, wherein each crosses a shear line, and is linearly displaceable along said pin chamber, each standard pin assembly comprising a tumbler pin, a driver pin and a biasing spring, arranged so as to define a locked cylinder position, in which said driver pin extends beyond the shear line, preventing rotation of the cylinder plug, said tumbler pin being positioned opposite said driver pin, within said pin chamber, said method comprising:

providing a modified pin assembly in said common cylinder lock to prevent impact-driven manipulation thereof, said modified pin assembly comprising a modified pin set comprising a tumbler pin and driver pin, said modified pin set being provided with motion alteration means adapted so as to alter the magnitude of its response to an impact-driven blow applied to said tumbler pin, relative to the magnitude of the response of the standard pin assemblies contained in said common cylinder lock, such that when said tumbler pin is linearly displaced in response to an impact-driven blow of a given intensity, a portion of said impact-driven blow intensity is transmitted to said driver pin, causing it to be linearly displaced, as well, under influence of said motion alteration means, and while said standard pin assemblies clear the shear line, said driver pin of said modified pin set continues to block the shear line, consequently, preventing unauthorized manipulation of said cylinder lock, wherein said motion alteration means of said modified pin assembly comprises a recession formed in one of said pins contained in said pin assembly, and a protrusion, in the other of said pins, for engaging said recession, such that when an impact-driven blow of a given intensity is applied so as to linearly displace said tumbler and driver pins, said pin protrusion engages said pin recession, strongly binding the tumbler and driver pins together.

5. The method of claim 4 wherein means are provided to enable release of said engaged tumbler and driver pins.

6. The method of claim 5 wherein said unauthorized manipulation is represented by said engaged tumbler and driver pins and said release of said engaged tumbler and driver pins indicates an attempted unauthorized manipulation.

7. A modified pin assembly in a common cylinder lock, said cylinder lock having a body and cylinder plug containing a plurality of standard pin assemblies, each of said plurality of standard pin assemblies being disposed in a pin chamber, wherein each crosses a shear line, and is linearly displaceable along said pin chamber, each standard pin assembly comprising a tumbler pin, a driver pin and a biasing spring, arranged so as to define a locked cylinder position, in which said driver pin extends beyond the shear line, preventing rotation of the cylinder plug, said tumbler pin being positioned opposite said driver pin, within said pin chamber, wherein said modified pin assembly prevents impact-driven manipulation of said lock, said modified pin assembly comprising:

a modified pin set comprising a tumbler pin and driver pin, said modified pin set being provided with motion alteration means adapted so as to alter the magnitude of its response to an impact-driven blow applied to said tumbler pin, relative to the magnitude of the response of the standard pin assemblies contained in said common cylinder lock, such that when said tumbler pin is linearly displaced in response to an impact-driven blow of a given intensity, a portion of said impact-driven blow intensity is transmitted to said driver pin, causing it to be linearly displaced, as well, under influence of said motion alteration means, and while said standard pin assemblies clear the shear line, said driver pin of said modified pin set continues to block the shear line, consequently preventing unauthorized manipulation of said cylinder lock, wherein said motion alteration means of said modified pin assembly comprises magnetic properties that cause binding of said tumbler pin and driver pin of said modified pin set, so as to travel together and provide different response properties in response to an applied impact-driven blow;

such that when an impact-driven blow of a given intensity is applied so as to Linearly displace said tumbler and driver pins, said magnetic properties maintain the tumbler and driver pins bound together.

8. A modified pin assembly in a common cylinder lock, said cylinder lock having a body and cylinder plug containing a plurality of standard pin assemblies, each of said plurality of standard pin assemblies being disposed in a pin chamber, wherein each crosses a shear line, and is linearly displaceable along said pin chamber, each standard pin assembly comprising a tumbler pin, a driver pin and a biasing spring, arranged so as to define a locked cylinder position, in which said driver pin extends beyond the shear line, preventing rotation of the cylinder plug, said tumbler pin being positioned opposite said driver pin, within said pin chamber, wherein said modified pin assembly prevents impact-driven manipulation of said lock, said modified pin assembly comprising:

a modified pin set comprising a tumbler pin and driver pin, said modified pin set being provided with motion alteration means adapted so as to alter the magnitude of its response to an impact-driven blow applied to said tumbler pin, relative to the magnitude of the response of the standard pin assemblies contained in said common cylinder lock, such that when said tumbler pin is linearly displaced in response to an impact-driven blow of a given intensity, a portion of said impact-driven blow intensity is transmitted to said driver pin, causing it to be linearly displaced, as well, under influence of said motion alteration means, and while said standard pin assemblies clear the shear line, said driver pin of said modified pin set continues to block the shear line, consequently preventing unauthorized manipulation of said cylinder lock, wherein said motion alteration means of said modified pin assembly is provided by modified strength properties of the biasing spring associated with said modified pin set in relation to biasing springs of said standard pin assemblies, said modified strength properties being sufficient to attain different response properties of said modified pin set to an applied impact-driven blow without resort to pin-bore frictional forces, causing said continued driver pin blockage of the shear line by said modified pin set.

* * * * *